US011465715B2

(12) United States Patent
Omidi

(10) Patent No.: US 11,465,715 B2
(45) **Date of Patent: *Oct. 11, 2022**

(54) PORTABLE FOLDABLE HOUSE FOR PETS AND HUMANS

(71) Applicant: Rayan Omidi, Katy, TX (US)

(72) Inventor: Rayan Omidi, Katy, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/524,127

(22) Filed: Nov. 11, 2021

(65) Prior Publication Data

US 2022/0081079 A1 Mar. 17, 2022

Related U.S. Application Data

(63) Continuation of application No. 17/313,980, filed on May 6, 2021, now Pat. No. 11,203,399.

(60) Provisional application No. 63/034,398, filed on Jun. 3, 2020.

(51) Int. Cl.

| | |
|---|---|
| ***B63B 35/44*** | (2006.01) |
| ***B63J 2/04*** | (2006.01) |
| ***B63B 13/00*** | (2006.01) |

(52) U.S. Cl.

CPC ..... *B63B 35/44* (2013.01); *B63B 13/00* (2013.01); *B63J 2/04* (2013.01); *B63B 2035/4426* (2013.01)

(58) Field of Classification Search

CPC . B63B 35/44; B63B 13/00; B63B 2035/4426; B63B 17/02; B63J 2/04

USPC ..... 114/352, 353

See application file for complete search history.

(56) References Cited

U.S. PATENT DOCUMENTS

| | | | | |
|---|---|---|---|---|
| 4,671,203 | A * | 6/1987 | Sanburg | B63B 17/02 135/132 |
| 5,615,640 | A * | 4/1997 | Luiz | A01K 1/034 119/482 |
| 6,615,762 | B1 * | 9/2003 | Scott | B63B 7/06 114/353 |
| 7,401,566 | B1 * | 7/2008 | Miknich | B63B 17/02 114/361 |
| 8,342,897 | B2 * | 1/2013 | Gater | B62M 17/00 440/27 |
| 8,430,044 | B2 * | 4/2013 | Foo | B62D 57/036 440/12.65 |
| 8,662,020 | B1 * | 3/2014 | Tecco | A01K 1/0245 119/497 |
| 10,273,915 | B2 * | 4/2019 | Saiga | B63H 20/32 |
| 10,286,987 | B2 * | 5/2019 | Duff | B63C 9/20 |
| 2007/0145708 | A1 * | 6/2007 | Davioni | B62M 1/12 280/233 |
| 2008/0188146 | A1 * | 8/2008 | Howard | B63H 16/20 440/30 |

FOREIGN PATENT DOCUMENTS

| | | | | |
|---|---|---|---|---|
| WO | WO-2009139775 | A1 * | 11/2009 | A01K 1/0236 |

* cited by examiner

*Primary Examiner* — Anthony D Wiest
(74) *Attorney, Agent, or Firm* — Brett A. Schenck

(57) ABSTRACT

A house is provided. The house includes a base and a roof. The roof is attached to the base. The base has sufficient buoyancy to enable the house to float on water.

16 Claims, 15 Drawing Sheets

PORTABLE FOLDABLE HOUSE FOR PETS AND HUMANS

CROSS-REFERENCE TO RELATED APPLICATIONS

This application is a continuation of U.S. application Ser. No. 17/313,980 filed May 6, 2021, which claims the benefit under 35 U.S.C. § 119(e) of Provisional Application No. 63/034,398 filed Jun. 3, 2020, the disclosures of which are incorporated by reference in their entirety.

FIELD

This application relates generally to a house for holding animals or people and particularly to houses that float on water.

BACKGROUND

Floods due to hurricanes or heavy rains can destroy or damages houses or other buildings. The strong waves may also damage or destroy houses. The damage is often very costly and may take years to rebuild. Also, people in those houses who choose to ride out the hurricane or flood often are lost or need to be rescued since the flood waters damages or destroy the house to such an extent that it can no longer be used for sheltering the storm.

Houses or other buildings may benefit from improvements.

SUMMARY

In one aspect of the present invention, a floatable house is provided. The floatable house includes a buoyant base and a roof. The base includes a top surface and curves around the edges of the top surface. The roof is attached to the base. The buoyant base has sufficient buoyancy to enable the house to float on water such that the entire top surface of the base is above the water line.

In another aspect of the present invention, a floatable house is provided. The floatable house includes a buoyant base and a roof. The buoyant base has sufficient buoyancy to enable the house to float on water. The base includes first and second base parts. The roof includes first and second roof parts. The first roof part is attached to the first base part and the second roof part is attached to the second base part. The floatable house further includes a first connector. The first base part is removably fixed to the second base part by the connector such that the first base part is stationary relative to the second base part when the first and second base parts are fixed to each other by the first connector. The floatable house further includes a flexible member. The first base part is attached to the second base part by the flexible member. The flexible member is configured to be folded to enable the first base part to be move relative to the second base part and be position against the second base part in a compact stowed position.

In another aspect of the present invention, a floatable house is provided. The floatable house includes a buoyant base and a roof. The buoyant base has sufficient buoyancy to enable the house to float on water. The roof comprises a plurality of roof parts. The roof parts are pivotally connected to the base and pivot relative to the base. The roof parts are removably connected to each other in an operative position. The roof parts may be removed from each other and pivoted from the operative position to a compact stowed position.

Other aspects of the disclosed invention will become apparent from the following detailed description, the accompanying drawings and the appended claims.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION

It will be readily understood that the components of the embodiments as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, etc. In other instances, well-known structures, materials, or operations are not shown or described in detail to avoid obfuscation. The following description is intended only by way of example, and simply illustrates certain example embodiments.

Figure 1:
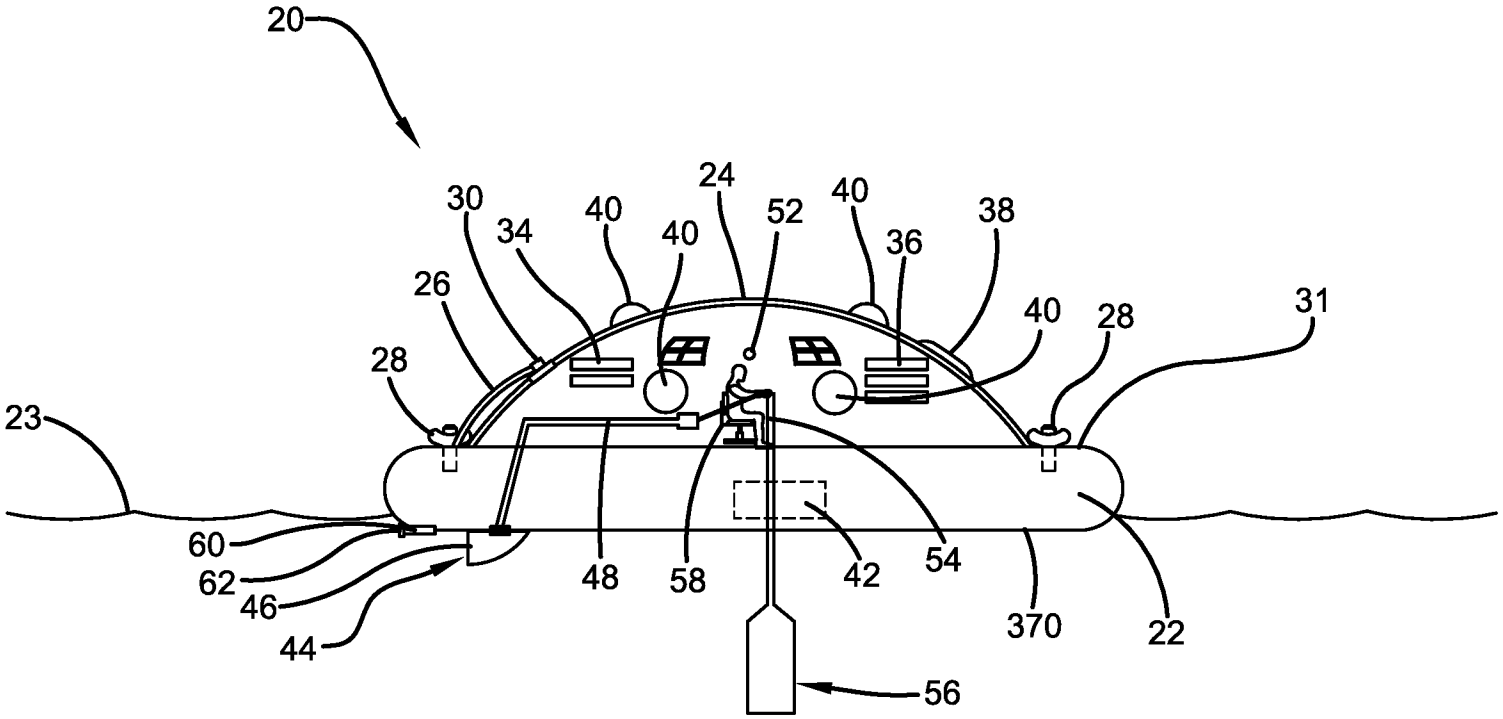
FIG. 1 is a left side view of a first embodiment of a floatable house of the present invention.

Throughout the present description, the terms "upper", "lower", "top", "bottom", "left", "right", "front", "forward", "rear", and "rearward" shall define directions or orientations with respect to the house as illustrated in FIG. 1, which shows a left side view of the house of the present invention. It will be understood that the spatially relative terms "upper", "lower", "top", "bottom", "left", "right", "front", "forward", "rear", and "rearward" are intended to encompass different orientations of the house in use or operation in addition to the orientation depicted in the figures. For example, if the house in the figures is turned over, elements described as "upper" elements or features would then be "lower" elements or features.

Figure 2:
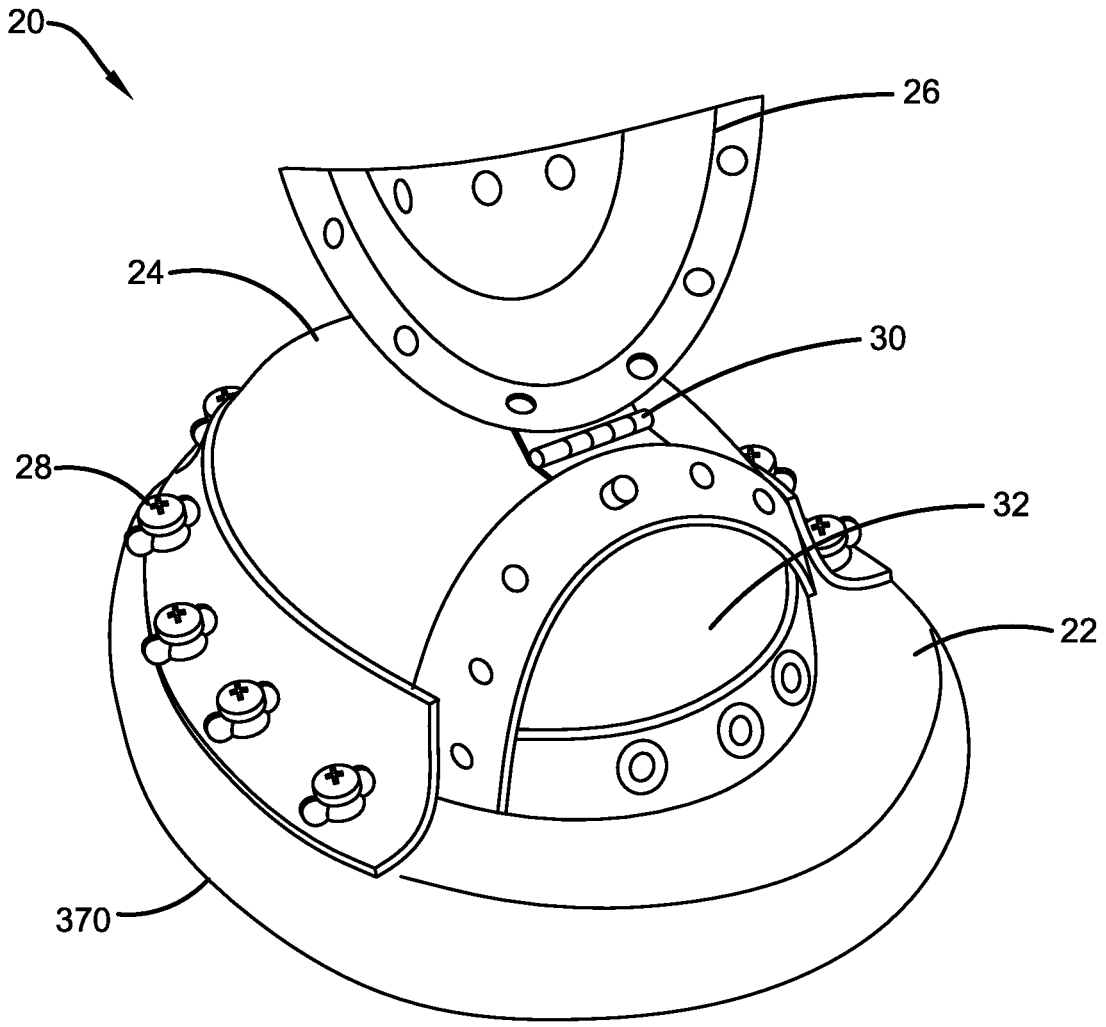
FIG. 2 is a top and rear perspective view of the first embodiment of FIG. 1 with the door of the house being opened.

FIGS. 1 and 2 illustrate a first embodiment of a floatable house 20 of the present invention. The house 20 includes a base 22, a roof 24, and a rear door 26. The base 22 is made of foam such as a closed-cell extruded polystyrene foam (e.g. Styrofoam®) or a similar light weight but strong foam that provides buoyancy to the house 20. This foam has a lower density of water and thus enables the base 22 and house 20 to float on water 23. The base 22 may also be made of a different plastic capsule. The base 22 is in one piece and is oval shaped and curves upwardly and outwardly from the bottom to define an inverted bell shaped. The base includes a top surface 31 that is entirely located above the water 23. The house 20 may float on the surface of the water in any rough conditions because of the shape of the base as described above, the curved ends of the base which touch the water, and also the lightness of the materials which are used to provide sufficient buoyance to enable the house to break the water easily while it is being moved in the water. The roof 24 defines a dome that is oval shaped and is made of flexible plastic. The roof 24 is removably secured on the top side of the base by fasteners 28 such as wing bolts or click lock connectors, or alternatively by glue or by other suitable ways. For each wing bolt, a wing nut 25 is fastened on a shank 19 of the wing bolt 28, and a washer 21 is sandwich between the wing nut 25 and the head 27 of the wing bolt 28 as illustrated in FIG. 12A.

Figure 18:
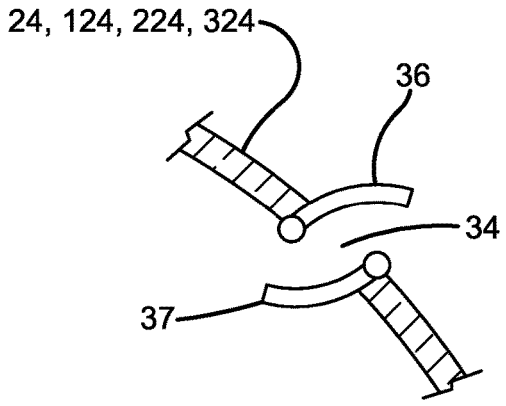
FIG. 18 is a sectional view of the roof taken along line 18-18 of FIG. 7.
Figure 20:
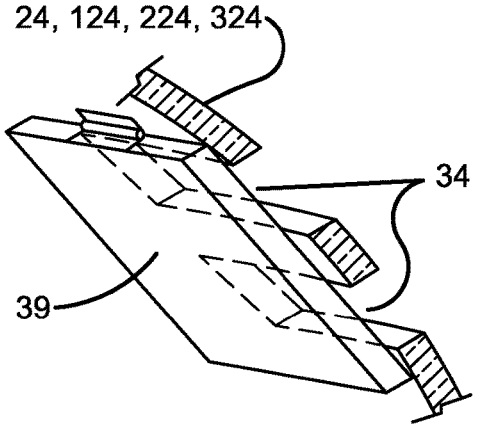
FIG. 20 is a sectional view similar to that of FIG. 18 but with an interior lid added and the lips removed for illustrative purposes.
Figure 21:
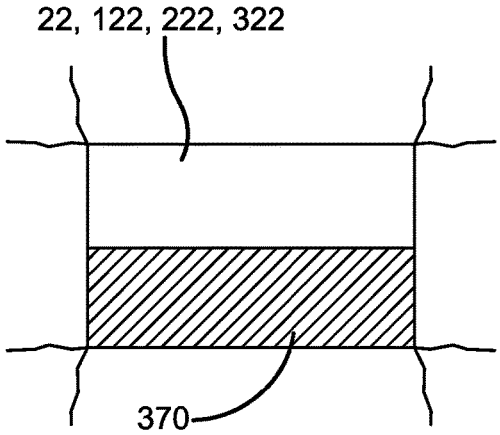
FIG. 21 is a partial sectional view of a portion of a floatable house showing the rubber coating covering the base at the bottom of the floatable house.

The rear door 26 is pivotally connected to a rear end of the roof 24 by a strap hinge 30 attached to the upper end of the rear door 26 and the roof 24 to enable the rear door 26 to pivot upwardly in an opened position (FIG. 2) and back downwardly in a closed position (FIG. 1). The rear door 26 extends to the rear end of the base 22 thereby covering the opening 32 (FIG. 2) between the roof 24 and base 22. Alternatively, the rear door 26 can be a sliding door. The rear door 26 may be tightened to the base by fasteners 28 such as wing bolts or catch lock connectors. The roof 24 includes vent openings 34 on the front and rear side of the house 20 to allow the flow of air in and out of the house 20, so that pets and persons housed inside can breathe easily. As illustrated in FIG. 18, outer and inner lips or vent edges 36, 37 extend partially over the vent openings 34 to restrict water from flowing through the vent openings 34 when, for example, it is raining. Specifically, the outer lip 36 is located outside the house 20 and may be attached to or near an upper end of a vent opening 34. The outer lip 36 may extend downwardly from the upper end of the vent openings 34 and partially over the vent opening 34. The inner lip 37 is located inside the house 20 and may be attached to or near a lower end of the vent opening 34. The inner lip 37 may extend partially underneath the vent opening 34 from the lower end of the vent opening 34. An interior lid 39 may be removably attached to the underside of the roof to cover the vent openings 34 from inside the house as illustrated in FIG. 20. The roof 24 may include a transparent window 38 or alternatively the roof 24 may be entirely transparent. The base 22 may include a round shaped weight 42 that is screwed into or otherwise installed in the center of the base 22 at the bottom of the base 22 to support the center of gravity of the house 20 to provide stability to the house 20 against strong winds, waves, and water current.

Figure 4:
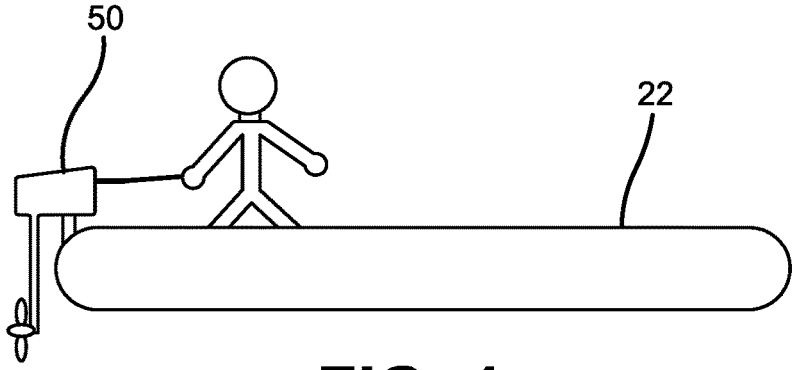
FIG. 4 is a left side view of the house of FIG. 1 and other embodiments of the present invention with a trolling or gas operated motor provided and with portions of the house removed for illustrative purposes.

A moveable rudder 44 is pivotally mounted to the base to steer the house 20 as it floats in the water. The rudder 44 includes a fin 46 and an elongated handle 48. The handle 48 is elongated to enable a user to turn or move the rudder right and left at 85 degree angles from the longitudinal axis of the boat for each of the right and left sides of the house 20 to steer the house 20. Alternatively or additionally, a trolling or gas operated motor 50 (FIG. 4) may be installed at the rear of the house 20. Alternatively or additionally, an access opening 52 may be provided in the roof 24 to enable a handle 54 of an oar 56 to pass through to allow a user to row the floatable house 20 with the oar. A seat or chair 58 may be provided in the house to allow a user to sit while operating the rudder 44, trolling or gas operated motor 50, or oar 56. The house 20 may include a sleeve 60 mounted to the base 22 that slidingly receives the fin 46 of the rudder 44 to allow the fin 46 to be slid to selected positions.

Figure 3A:
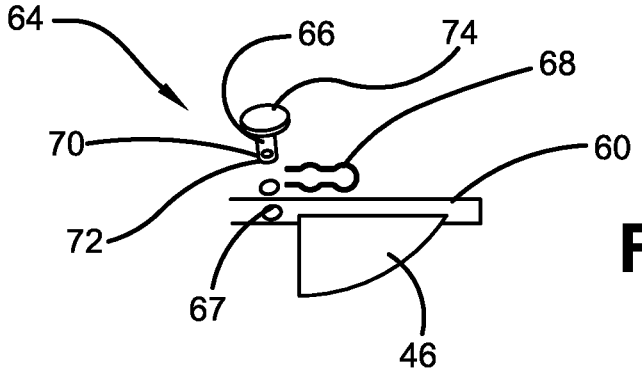
FIG. 3A is a left side view of a portion of a house of FIG. 1 and other embodiments of the present invention showing the rudder, locking mechanism for the rudder, and related parts.
Figure 3B:
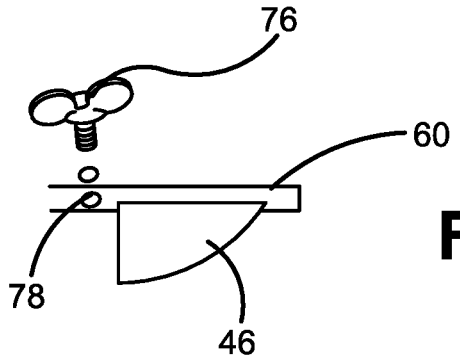
FIG. 3B is as left side view of the portion of the house of FIG. 3A but with a first alternative locking mechanism.
Figure 3C:
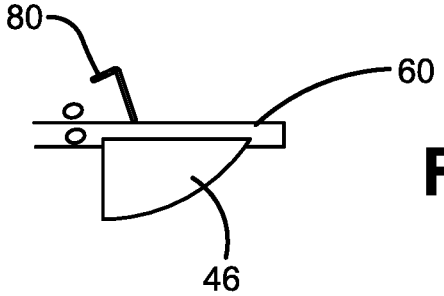
FIG. 3C is as side view of the portion of the house of 3A but with a second alternative locking mechanism.
Figure 3D:
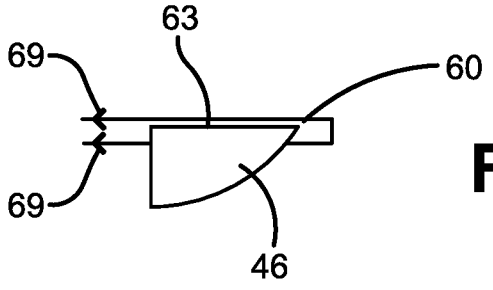
FIG. 3D is a left side view of a portion of the house showing the locking mechanism for the rudder with latches and other related parts.

A locking mechanism 62 may cooperated with the sleeve 60 to lock the fin 46 in a selected position along the sleeve 60. The locking mechanism 62 may be a pin, spring lock, screw, wing screw or other suitable mechanism. FIG. 3A illustrates a first example of the locking mechanism 62. In this example, the locking mechanism 62 comprises a cotter pin assembly 64 in which a pin 66 is slidably inserted into aligned holes 67 at the distal end of the sleeve 60 and then locked therein by a u-shaped spring 68 inserted into a hole 70 in a shank 72 of the pin as illustrated in FIG. 3A. The opposite ends of the sleeve are sandwiched between a head 74 of the pin and the spring 68 In a second example, the locking mechanism 62 comprises a wing screw 76 that screws into and threadily engages aligned threaded holes 78 at the distal end of the sleeve 60 as shown in FIG. 3B. In a third example, the locking mechanism may be a spring lock 80 in the form of a push-push mechanism that is part of the sleeve as illustrated in FIG. 3C. Specifically, the spring goes through a hole at the distal end of the sleeve. Pushing the top portion of the spring lock will urging the spring lock 80 up away from the sleeve to allow the rudder 44 to slide out. The sleeve 60 may have a release button that when pressed, unlocks the locking mechanism 62 and allows removal of the fin 46. As depicted in FIG. 3D, latches 69 may be pivotally mounted on sliding groove 63 at the distal end of the sleeve 60 to prevent the fin from sliding out of the sleeve 60. The latches 69 are initially locked in the position shown in FIG. 3D to prevent the fin 46 from sliding out. The latches 69 can be unlocked and pivotally moved out of the groove by pressing a release button or using other suitable ways to unlock the latches 69, so that the fin 46 may be allowed to slide out of the sleeve 60.

Figure 5:
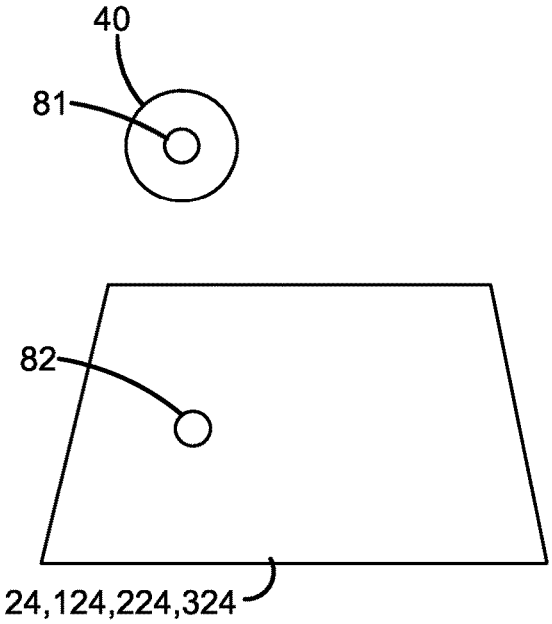
FIG. 5 is an exploded view of a portion of the house of FIG. 1 and other embodiments of the present invention illustrating the connection of a foam ball to the roof.
Figure 6:
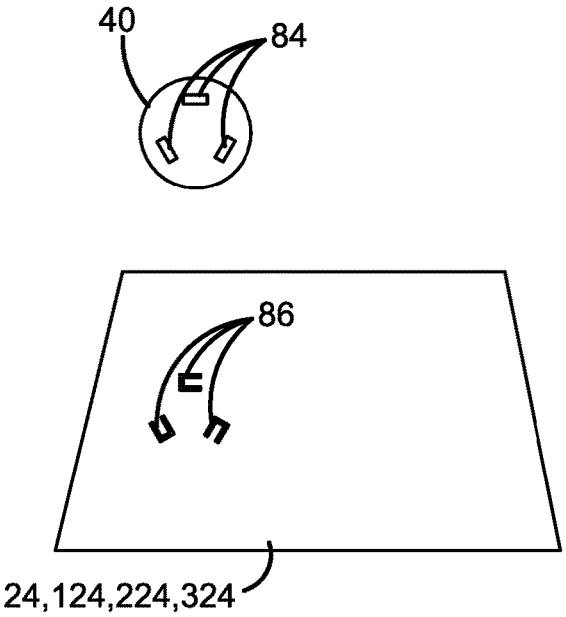
FIG. 6 is a view similar to that of FIG. 5 except that an alternative way of connecting the foam ball to the roof is illustrated.

As depicted in FIG. 1, foam balls 40 may also be mounted to the roof 24 to provide additional buoyancy to the house 20 to support the house 20 and prevent the house 20 from capsizing in the water from strong waves. As seen in FIG. 5, one or more of the balls 40 may include a threaded fastener 81 that engages a threaded hole 82 in the roof 24. Alternatively, one or more of the balls 40 may include tabs 84 that engage grooves 86 formed in the roof as illustrated in FIG. 6. Specifically, the tabs 84 are inserted into the grooves 86 and then the ball 40 is turned or twisted such that the tabs 84 engage the underside of the roof 24.

Figure 7:
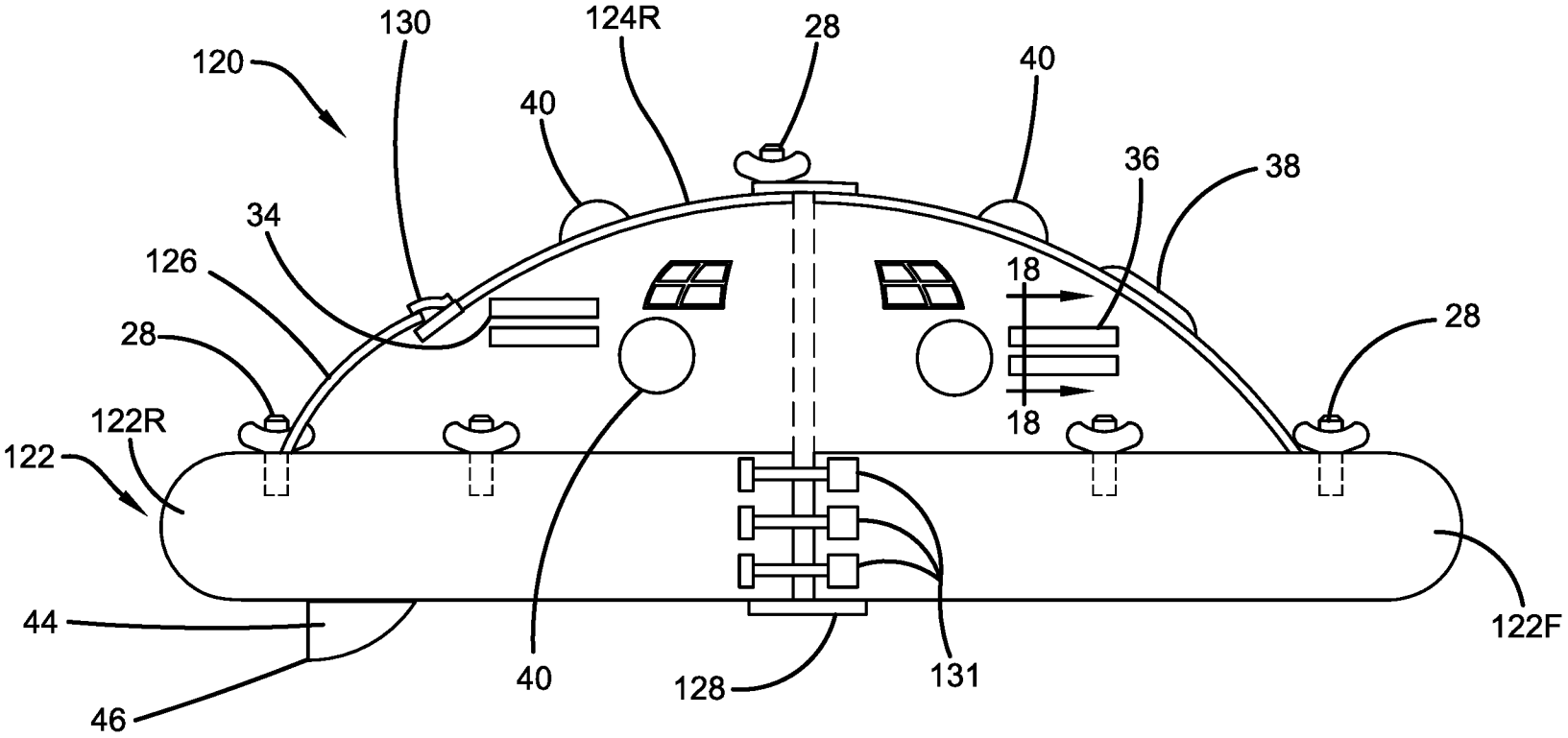
FIG. 7 is a left side view of a second embodiment of a floatable house of the present invention in the operative position.
Figure 8:
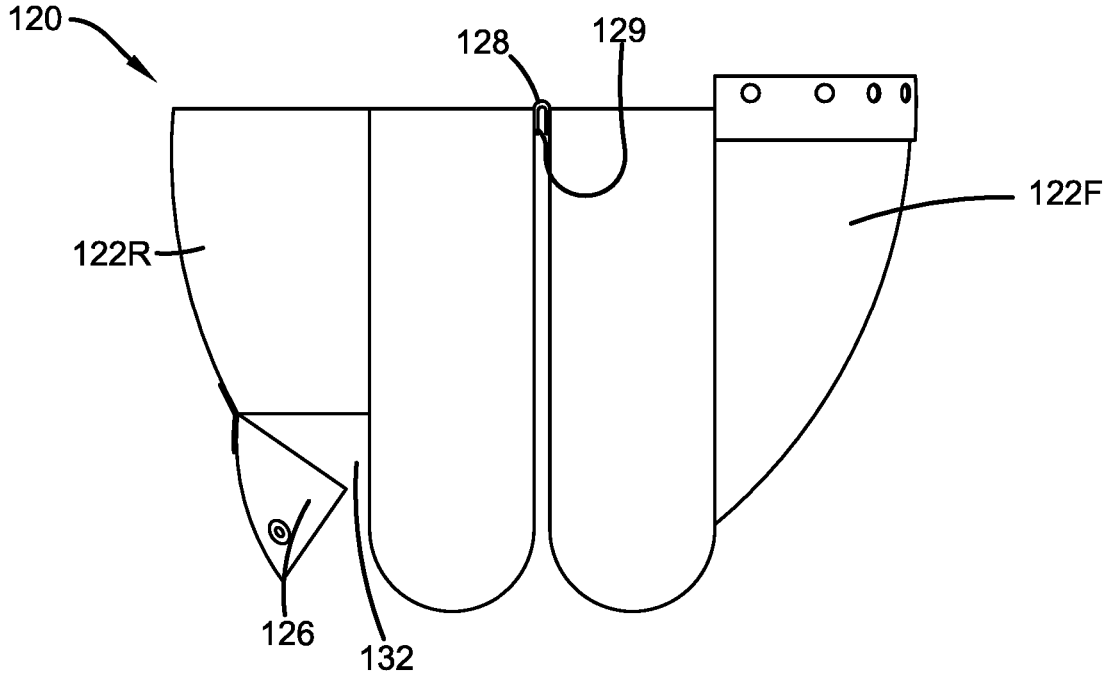
FIG. 8 is a left side perspective view of the second embodiment of a floatable house of the present invention in the stowed position with the door opened.
Figure 9:
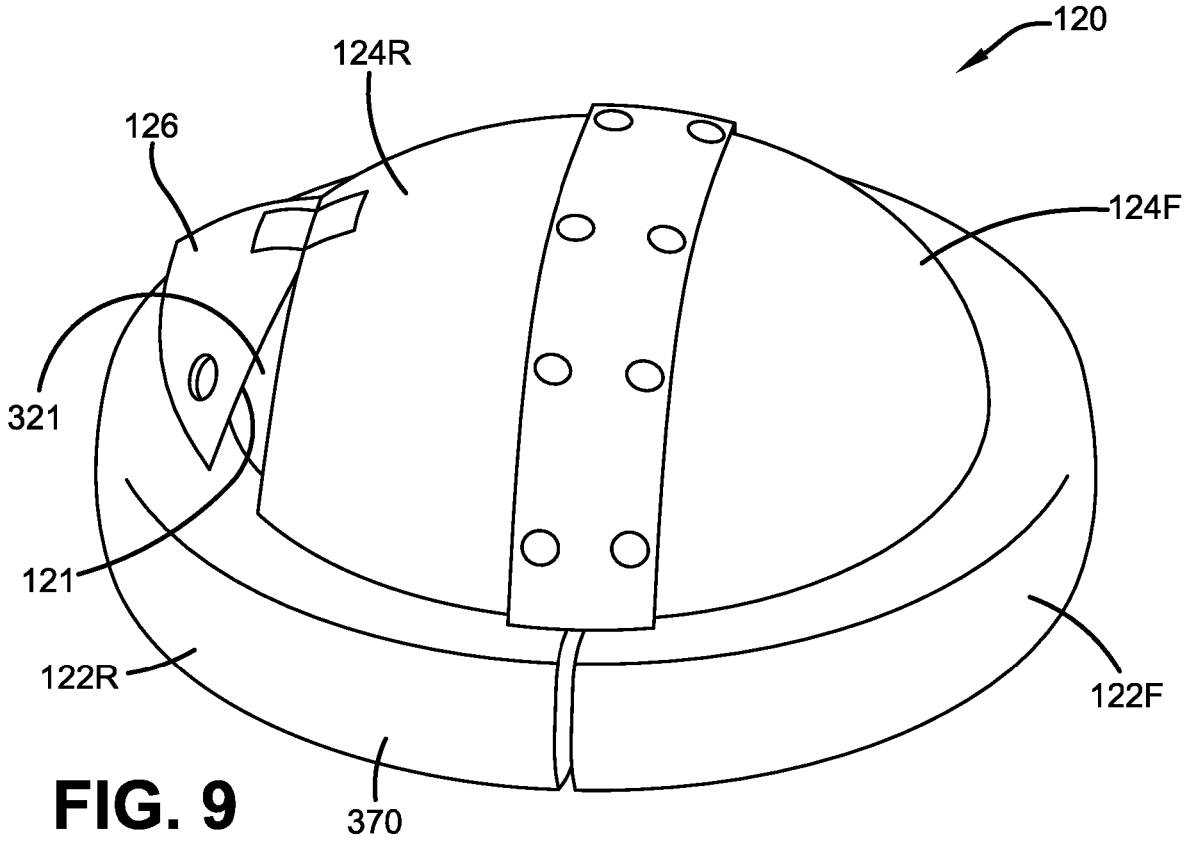
FIG. 9 is a top and left perspective view of the second embodiment of a floatable house of the present invention in the operative position with the door opened.
Figure 19:
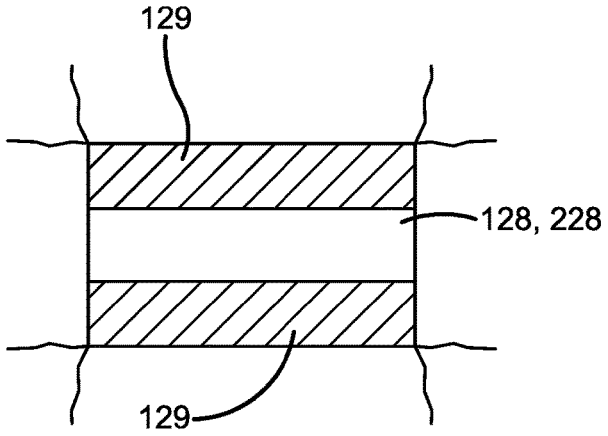
FIG. 19 is a partial sectional view of a portion of the floatable house showing the rubber coating covering the hinge strap of the floatable house.

FIGS. 7 to 9 show a second embodiment of the present invention. In this embodiment elements that are similar in function with the first embodiments will be given the same reference numbers. In this second embodiment, the house 120 comprises a base 122, a roof 124, and a rear door 126. The base 122 is made of foam such as a closed-cell extruded polystyrene foam (e.g. Styrofoam®) or a similar light weight but strong foam that provides buoyancy to the house 20. This foam has a lower density of water and thus enables the base 122 and house 120 to float on water 23. The base 122 may also be made of a different plastic capsule. The base may be comprised of front and rear base parts 122F, 122R, which are attached together at the bottom of the base 122 by a waterproof flexible strap hinge 128, which is covered by a flexible waterproof rubber coating 129 (FIGS. 8 and 19) to protect the strap 128 from chipping, cracking and breaking. The strap hinge 128 may be made of nylon, leather, or different waterproof fabrics. The strap hinge 128 can be folded to enable the front and rear base parts 122F, 122R to be moved relative to each other such that the bottoms of the front and rear base parts are positioned against each other in a compact stowed position as show in FIG. 8 while staying connected to each other by the strap hinge 128. Catch or click lock connectors 131 are mounted to the opposing ends of the front and rear base parts 122F, 122R to removably attached and tighten the front and rear base parts 122F, 122R together when unfolded from each other in the operative position as shown in FIGS. 7 and 9. In the operative position, the front and rear base parts are stationary relative to each other. Other types of connectors may be used instead of the catch or click lock connectors. For example, suitable connectors may include post clamp or a clamp and rod bolt arrangement.

In this second embodiment, the roof is comprised of front and rear roof parts 124F, 124R made of flexible plastic. The front and rear roof parts 124F, 124R are removably secured on the top side of the base by fasteners 28 such as wing bolts. The front and rear roof parts 124F, 124R are also removably secure to each other by fasteners 28 such as wing bolts. Alternatively, the front and rear roof parts 124F, 124R may be glued on the base 122 or secured to the base 122 by other suitable ways. The front and rear roof parts 124F, 124R are attached to each other in the operative position of the house 120 and removed from each other in the compact stowed position of the house 120.

The rear door 126 is pivotally connected to a rear end of the rear roof part 124R by a strap hinge 130 attached to an upper end 121 (FIG. 9) of the rear door 126 and the rear roof part 124R to enable the rear door 126 to pivot upwardly in an opened position (FIG. 9) and back downwardly in a closed position (FIG. 7). The rear door 126 extends to the rear end of the base 122 thereby covering an opening 132 (FIGS. 8 and 9) between the roof 124 and the base 122. Alternatively, the rear door 126 can be a sliding door. The rear door 126 may be tightened to the base by fasteners 28 such as wing bolts or catch lock connectors. The roof 124 includes vent openings 34 on the front and rear side of the house 120 to allow the flow of air in and out of the house 120, so that pets housed inside can breathe easily. Lips or vent edges 36, 37 extend partially over the vent openings 34 to restrict water from flowing through the vent openings 34 when, for example, it is raining as illustrated in FIG. 18. An interior lid 39 may be removably attached to the underside of the roof to cover the vent openings 34 from inside the house as illustrated in FIG. 20. The roof 124 may include a transparent window 38 or alternatively the roof 124 may be entirely transparent.

Similar to the first embodiment, a moveable rudder 44 is pivotally mounted to the base to steer the house 120 as it floats in the water. The rudder 44 includes a fin 46 and an elongated handle 48 (FIG. 1). The handle 48 is elongated to enable a user to turn or move the rudder right and left at 85 degree angles from the longitudinal axis of the base 122 for each of the right and left sides of the house 120 to steer the house 120. Alternatively or additionally, a trolling or gas operated motor 50 (FIG. 4) may be installed at the rear of the house 120. Alternatively or additionally, an access opening 52 (FIG. 1) may be provided in the roof 124 to enable a handle 54 of an oar 56 to pass through to allow a user to row the floatable house 120 with the oar. A seat or chair 58 may be provided in the house to allow a user to sit while operating the rudder 44, trolling or gas operated motor 50, or oar 56. The house 120 may include a sleeve 60 mounted to the base 122 that slidingly receives the fin 46 of the rudder 44 to allow the fin 46 to be slid to selected positions.

A locking mechanism 62 may cooperated with the sleeve 60 to lock the fin 46 in a selected position along the sleeve 60. The locking mechanism 62 may be a pin, spring lock, screw, wing screw or other suitable mechanism. FIG. 3A illustrates a first example of the locking mechanism 62. In this example, the locking mechanism 62 comprises a cotter pin assembly 64 in which a pin 66 is slidably inserted into aligned holes 67 at the distal end of the sleeve 60 and then locked therein by a u-shaped spring 68 inserted into a hole 70 in a shank 72 of the pin as illustrated in FIG. 3A. The opposite ends of the sleeve are sandwiched between a head 74 of the pin and the spring 68 In a second example, the locking mechanism 62 comprises a wing screw 76 that screws into and threadily engages aligned threaded holes 78 at the distal end of the sleeve 60 as shown in FIG. 3B. In a third example, the locking mechanism may be a spring lock 80 in the form of a push-push mechanism that is part of the sleeve as illustrated in FIG. 3C. Specifically, the spring goes through a hole at the distal end of the sleeve. Pushing the top portion of the spring lock will urging the spring lock 80 up away from the sleeve to allow the rudder 44 to slide out. The sleeve 60 may have a release button that when pressed, unlocks the locking mechanism 62 and allows removal of the fin 46. As depicted in FIG. 3D, latches 69 may be pivotally mounted on sliding groove 63 at the distal end of the sleeve 60 to prevent the fin from sliding out of the sleeve 60. The latches 69 are initially locked in the position shown in FIG. 3D to prevent the fin 46 from sliding out. The latches 69 can be unlocked and pivotally moved out of the groove by pressing a release button or using other suitable ways to unlock the latches 69, so that the fin 46 may be allowed to slide out of the sleeve 60.

Foam balls 40 may also be mounted to the roof 124 to provide additional buoyancy to the house 120 to support the house 120 and prevent the house 120 from capsizing in the water from strong waves. As seen in FIG. 5, one or more of the balls 40 may include a threaded fastener 81 that engages a threaded hole 82 in the roof 124. Alternatively, one or more of the balls 40 may include tabs 84 that engage grooves 86 formed in the roof 124 as illustrated in FIG. 6. Specifically, the tabs 84 are inserted into the grooves 86 and then the ball 40 is turn or twisted such that the tabs 84 engage the underside of the roof 124. In the stowed position as illustrated in FIG. 8, the front and rear roof parts 124F, 124R are secured on the top side of their respective front and rear base parts 122F, 122R, and the front base part 122F is folded to the rear base part 122R such that the bottom sides of the front and rear base parts 122F, 122R face each other.

Figure 10:
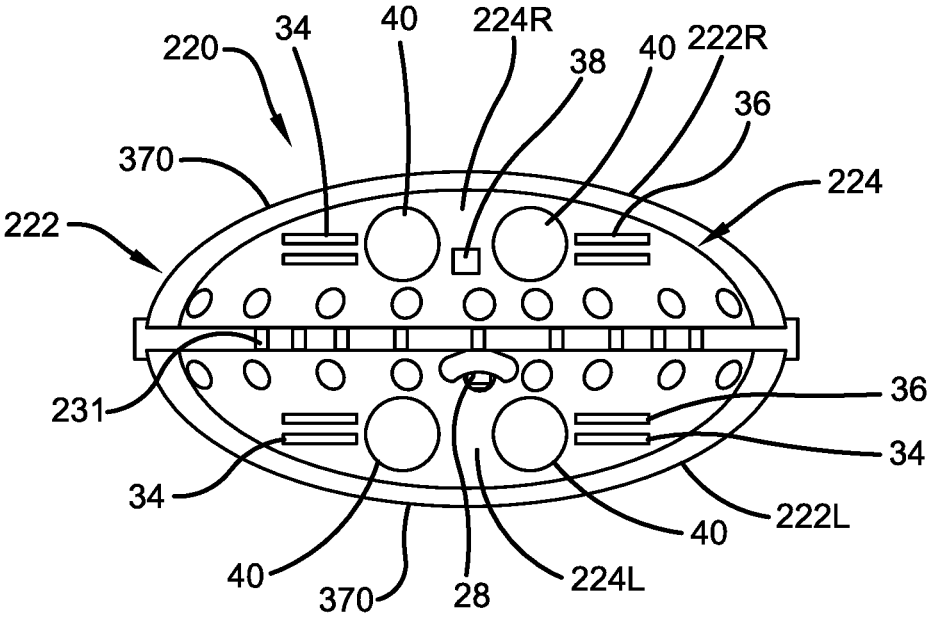
FIG. 10 is a top view of a third embodiment of a floatable house of the present invention in an operative position.
Figure 11:
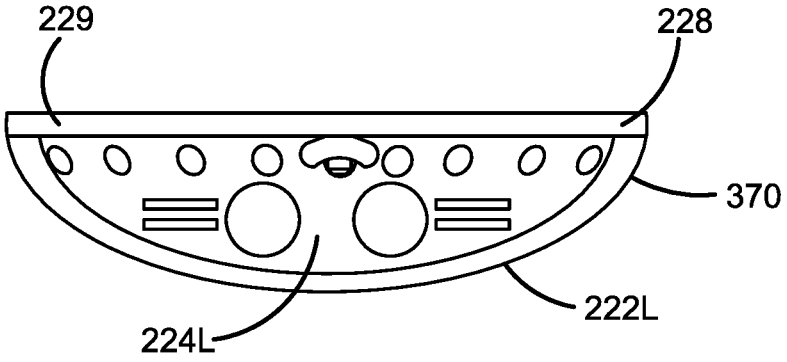
FIG. 11 is a side view of the floatable house of FIG. 10 in a stowed position.

FIGS. 10 and 11 show a third embodiment of the present invention. In this embodiment elements that are similar in function with the first embodiments will be given the same reference numbers. In this third embodiment, the house 220 is oval shaped and includes a base 222 and a roof 224. The base 222 is made of foam such as a closed-cell extruded polystyrene foam (e.g. Styrofoam®) or a similar light weight but strong foam that provides buoyancy to the house 220. This foam has a lower density of water and thus enables the base 222 and house 220 to float on water 23. The base 222 may also be made of a different plastic capsule. The base 222 is oval or round shaped and comprise left and right base parts 222L, 222R, which are attached together at the bottom of the base 222 by a waterproof flexible strap hinge 228, which is covered by flexible waterproof rubber coating 129 (FIG. 19) to protect the strap 228 from chipping, cracking and breaking. The strap hinge 228 may be made of nylon, leather, or different waterproof fabrics. The strap hinge 228 can be folded to enable the left and right base parts 222L, 222R to be positioned against each other at their bottoms in a stowed position as show in FIG. 8. Catch or click lock connectors 231 are mounted to the opposing ends of the left and right base parts 222L, 222R to removably attached and tighten the left and right base parts 222L, 222R together to inhibit movement relative to each other when unfolded from each other in the operative position as shown in FIG. 10. Other types of connectors may be used instead of the catch or click lock connectors. For example, suitable connectors may include post clamp or a clamp and rod bolt arrangement.

In this embodiment, the roof 224 is comprised of right and left roof parts 224R, 224L made of flexible plastic. The right and left roof parts 224R, 224L are removably secured on the top side of the base 222 by fasteners 28 such as wing bolts. The right and left roof parts 224R, 224L are also removably secure to each other by adhesive, wing bolts or other suitable ways. The right and left roof parts 224R, 224L are removed from each other in the compact stowed position of the house 220 and attached to each other in the operative position of the house 220. The roof 224 includes vent openings 34 on the front and rear side of the house 220 to allow the flow of air in and out of the house 220, so that pets housed inside can breathe easily. Lips or vent edges 36, 37 extend partially over the vent openings 34 to restrict water from flowing through the vent openings 34 when, for example, it is raining as illustrated in FIG. 18. An interior lid 39 may be removably attached to the underside of the roof to cover the vent openings 34 from inside the house as illustrated in FIG. 20. The roof 224 may include a transparent window 38 or alternatively the roof 224 may be entirely transparent.

Similar to the first embodiment, a moveable rudder 44 may be pivotally mounted to the base 222 to steer the house 220 as it floats in the water. The rudder 44 includes a fin 46 and an elongated handle 48 (FIG. 1). The handle 48 is elongated to enable a user to turn or move the rudder right and left at 85 degree angles from the longitudinal axis of the base 222 for each of the right and left sides of the house 220 to steer the house 220. Alternatively or additionally, a trolling or gas operated motor 50 (FIG. 4) may be installed at the rear of the house 220. Alternatively or additionally, an access opening 52 (FIG. 1) may be provided in the roof 224 to enable a handle 54 of an oar 56 to pass through to allow a user to row the floatable house 220 with the oar. A seat or chair 58 may be provided in the house 220 to allow a user to sit while operating the rudder 44, trolling or gas operated motor 50, or oar 56. The house 220 may include a sleeve 60 mounted to the base 222 that slidingly receives the fin 46 of the rudder 44 to allow the fin 46 to be slid to selected positions.

A locking mechanism 62 may cooperated with the sleeve 60 to lock the fin 46 in a selected position along the sleeve 60. The locking mechanism 62 may be a pin, spring lock, screw, wing screw or other suitable mechanism. FIG. 3A illustrates a first example of the locking mechanism 62. In this example, the locking mechanism 62 comprises a cotter pin assembly 64 in which a pin 66 is slidably inserted into aligned holes 67 at the distal end of the sleeve 60 and then locked therein by a u-shaped spring 68 inserted into a hole 70 in a shank 72 of the pin as illustrated in FIG. 3A. The opposite ends of the sleeve are sandwiched between a head 74 of the pin and the spring 68 In a second example, the locking mechanism 62 comprises a wing screw 76 that screws into and threadily engages aligned threaded holes 78 at the distal end of the sleeve 60 as shown in FIG. 3B. In a third example, the locking mechanism may be a spring lock 80 in the form of a push-push mechanism that is part of the sleeve as illustrated in FIG. 3C. Specifically, the spring goes through a hole at the distal end of the sleeve. Pushing the top portion of the spring lock will urging the spring lock 80 up away from the sleeve to allow the rudder 44 to slide out. The sleeve 60 may have a release button that when pressed, unlocks the locking mechanism 62 and allows removal of the fin 46. As depicted in FIG. 3D, latches 69 may be pivotally mounted on sliding groove 63 at the distal end of the sleeve 60 to prevent the fin from sliding out of the sleeve 60. The latches 69 are initially locked in the position shown in FIG. 3D to prevent the fin 46 from sliding out. The latches 69 can be unlocked and pivotally moved out of the groove by pressing a release button or using other suitable ways to unlock the latches 69, so that the fin 46 may be allowed to slide out of the sleeve 60.

Foam balls 40 may also be mounted to the roof 224 to provide additional buoyancy to the house 220 to support the house 220 and prevent the house 220 from capsizing in the water from strong waves. As seen in FIG. 5, one or more of the balls 40 may include a threaded fastener 81 that engages a threaded hole 82 in the roof 224. Alternatively, one or more of the balls 40 may include tabs 84 that engage grooves 86 formed in the roof 224 as illustrated in FIG. 6. Specifically, the tabs 84 are inserted into the grooves 86 and then the ball 40 is turn or twisted such that the tabs 84 engage the underside of the roof 224. In the stowed position as illustrated in FIG. 11, the right and left roof parts 224R, 224L are secured on the top side of their respective right and left base parts 222R, 222L, and the right base part 222R is folded onto the left base part 222L such that the bottom sides of the right and left base parts 222R, 222L face each other.

Figure 12:
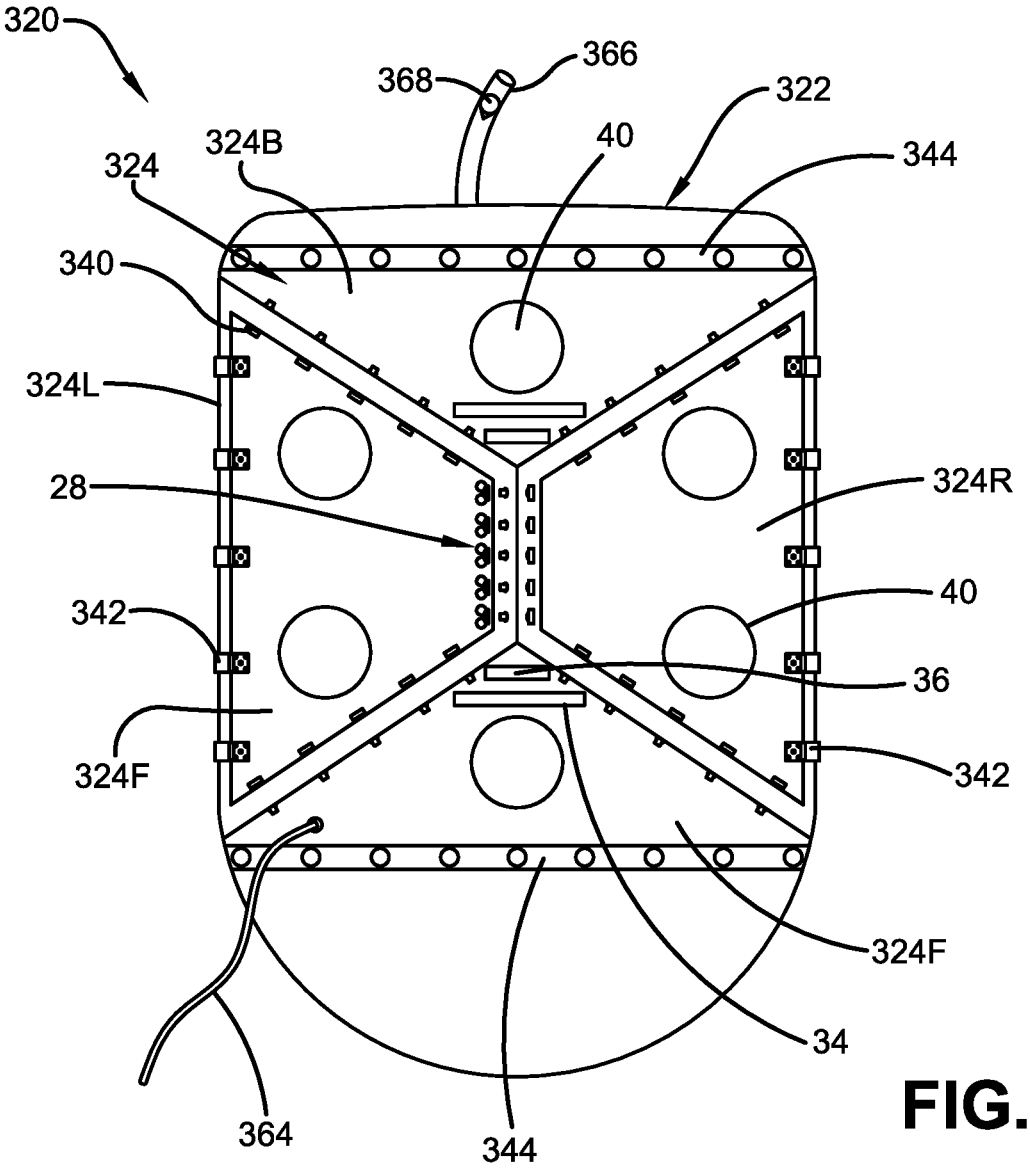
FIG. 12 is a top view of a fourth embodiment of a floatable house of the present invention.
Figure 12A:
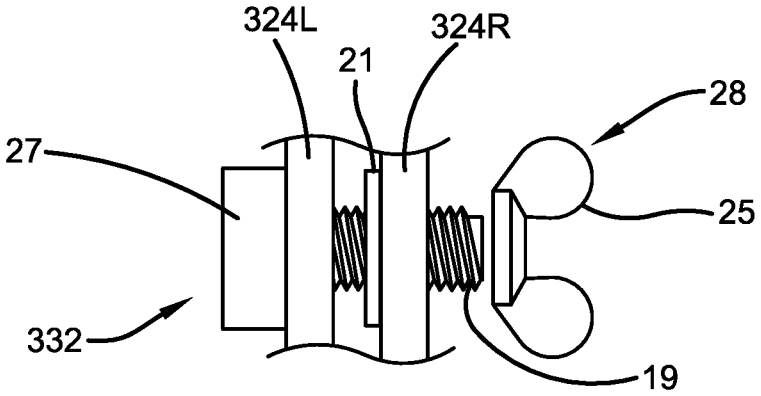
FIG. 12A is an exploded view of a portion of the floatable house of FIG. 12 showing the wing bolt fastener.
Figure 13:
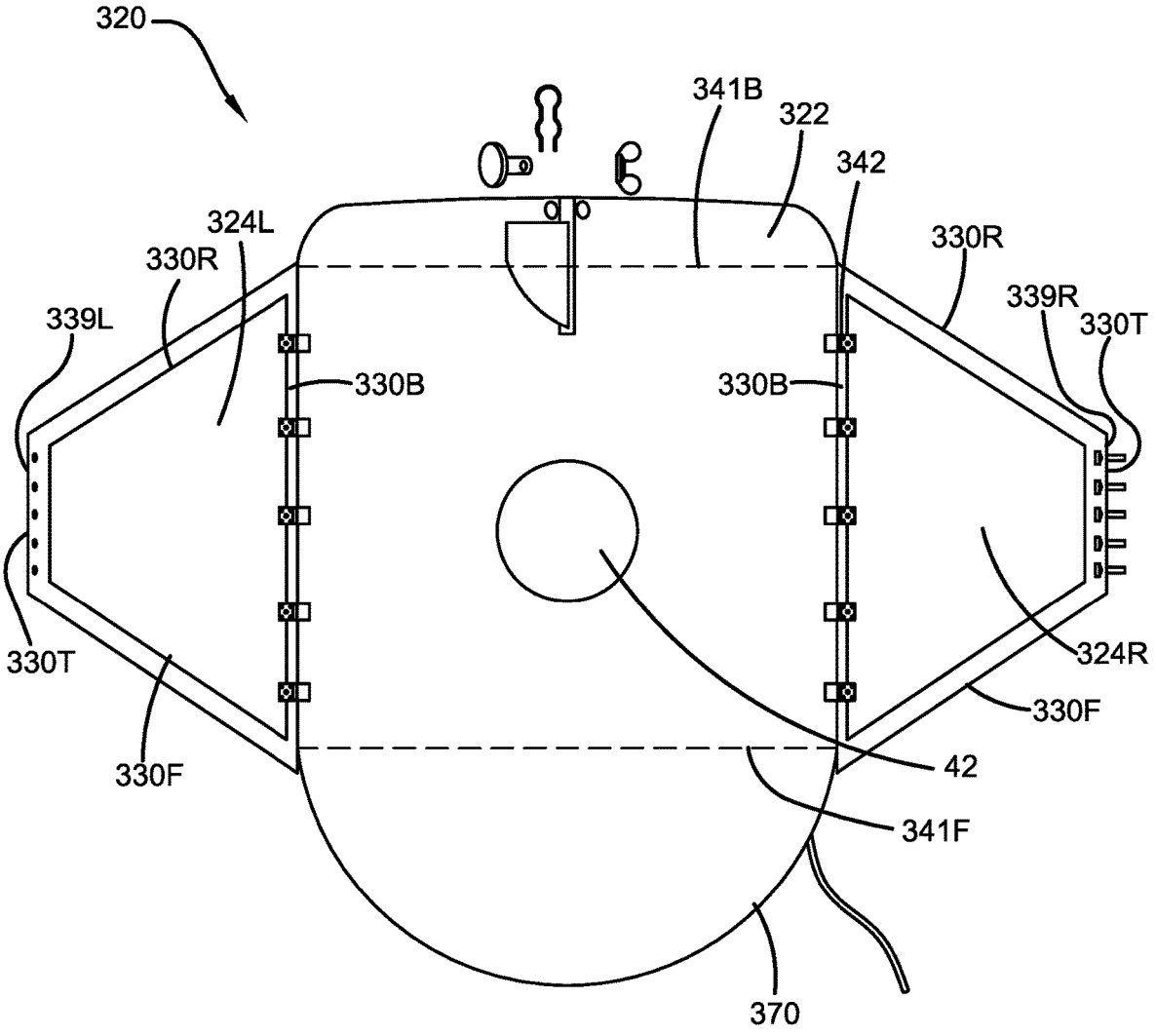
FIG. 13 is a bottom view of the house of FIG. 12 with the roof sidings removed from each other and unfolded away from each other.

FIGS. 12 to 15 show a fourth embodiment of the present invention. In this embodiment elements that are similar in function with the first embodiments will be given the same reference numbers. In this fourth embodiment, the house 320 includes a base 322 and roof 324. Referring to FIGS. 12 and 13, the base 322 is comprise of foam such as a closed-cell extruded polystyrene foam (e.g. Styrofoam®) or a similar light weight but strong foam that provides buoyancy to the house 320. This foam has a lower density of water and thus enables the base 322 and house 320 to float on water 23. The base 322 may also be made of a different plastic capsule. The base 322 is in one piece and is oval shaped. The roof 324 is gabled and defines an inverted v shape.

Figure 14:
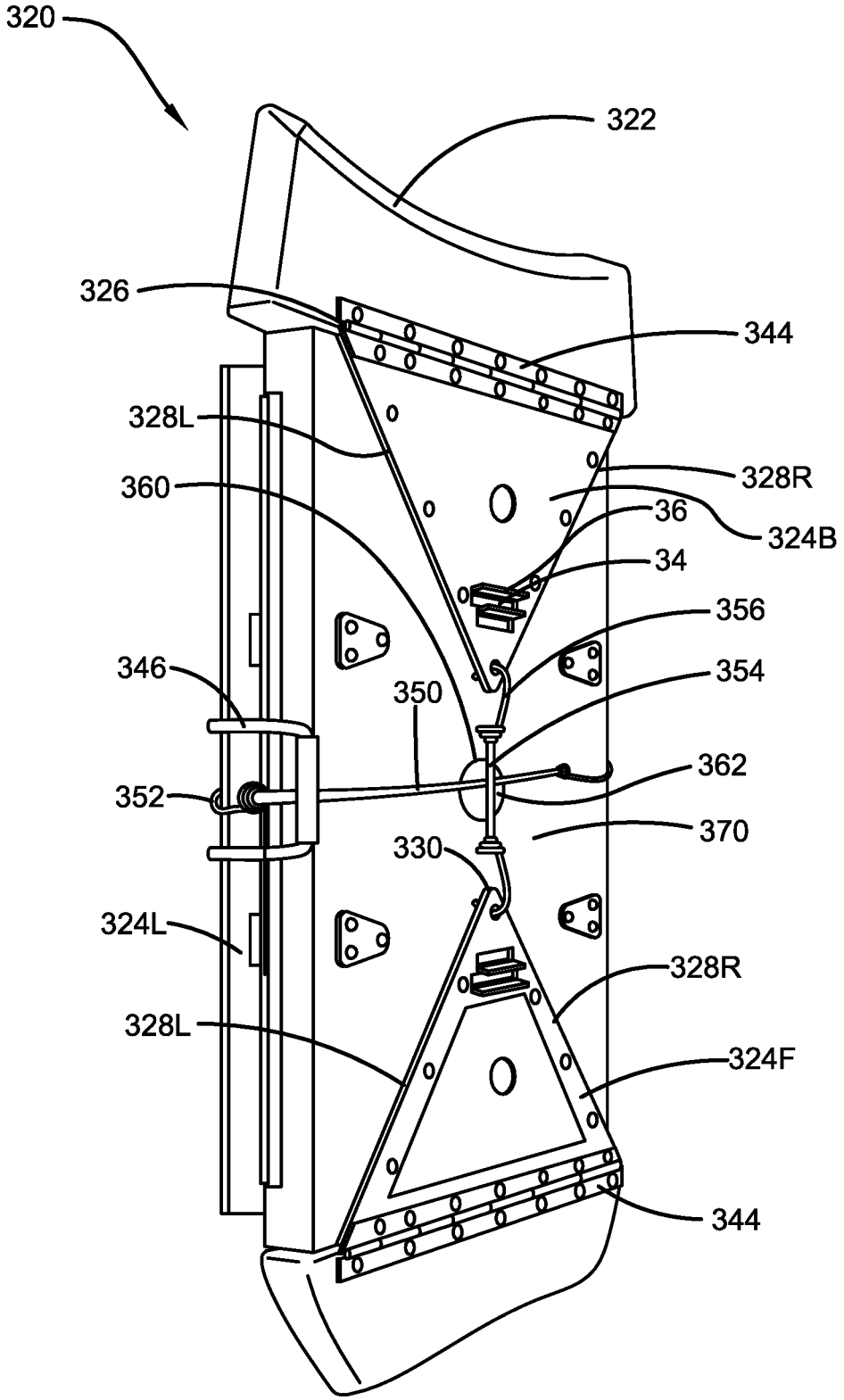
FIG. 14 is a top and left side perspective view of the house of FIG. 12 in the stowed position.

The roof 324 includes front, rear, right and left roof sidings 324F, 324B, 324R, 324L made of flexible plastic. The front and rear roof sidings 324F, 324B are triangular shaped having a bottom end 326 (FIG. 14) and right and left side ends 328R, 328L (FIG. 14). The side ends 328R, 328L for each of the front and rear roof sidings 324F, 324B converge going upwardly from the bottom end terminating into a top vertice 330 (FIG. 14). The front roof siding 324F slopes downwardly and outwardly (i.e. forwardly) from the top vertice 330. The rear roof siding 324B slopes downwardly and outwardly (i.e. rearwardly) from the top vertice 330. The front roof siding 324F may be transparent for viewing inside or outside the house 320.

Vent openings 34 are provided on the front and rear roof sidings 324F, 324B of the house 320 to allow the flow of air in and out of the house 320, so that pets housed inside can breathe easily. Lips or vent edges 36, 37 extend partially over the vent openings 34 to restrict water from flowing through the vent openings 34 when, for example, it is raining as illustrated in FIG. 18. An interior lid 39 may be removably attached to the underside of the roof to cover the vent openings 34 from inside the house as illustrated in FIG. 20. The roof 324 may include a transparent windows 38 or alternatively the roof 324 may be entirely transparent. The right and left roof sidings 324R, 324L are trapezoidal in shape and include top, bottom, and front and rear ends 330T, 330B, 330F, 330R (FIG. 14). The top and bottom ends 330T, 330B are parallel to each other with the top end 330T being smaller than the bottom end 330B. The right roof siding slopes downwardly and outwardly from the top end 330T. The left roof siding 324L also slopes downwardly and outwardly from the top end 330T.

The top ends 330T of the right and left roof sidings are positioned parallel and adjacent to each other in the operative position. Connectors 332 are provided to removably attached the top ends 330T to each other. Each connector comprises a nut and bolt arrangement in which a threaded wing bolt 28 extends through the top ends 330T. A wing nut 25 is threadily fastened to a shank 19 of the bolt 28 at an end opposite the head 27 of the wing bolt 28 as seen in FIG. 12A. Alternatively, other types of connectors can be used such as catch or click lock connectors. The front end 330F of the right roof siding 324R is positioned parallel and adjacent to the right end 328R of the front roof siding, and the rear end 330R of the right roof siding 324R is positioned parallel and adjacent to the right end 328R of the rear roof siding 324R. The front end 330F of the left roof siding 324L is positioned parallel and adjacent to the left end 328L of the front roof siding 324F, and the rear end 330R of the left roof siding 324L is position parallel and adjacent to the left end 328L of the rear roof siding 324B. Each pair of adjacent roof sidings are removably connected together by catch or clock lock connectors 340. Connectors other than catch or click lock connectors may include post clamp or a clamp and rod bolt arrangement.

Figure 15:
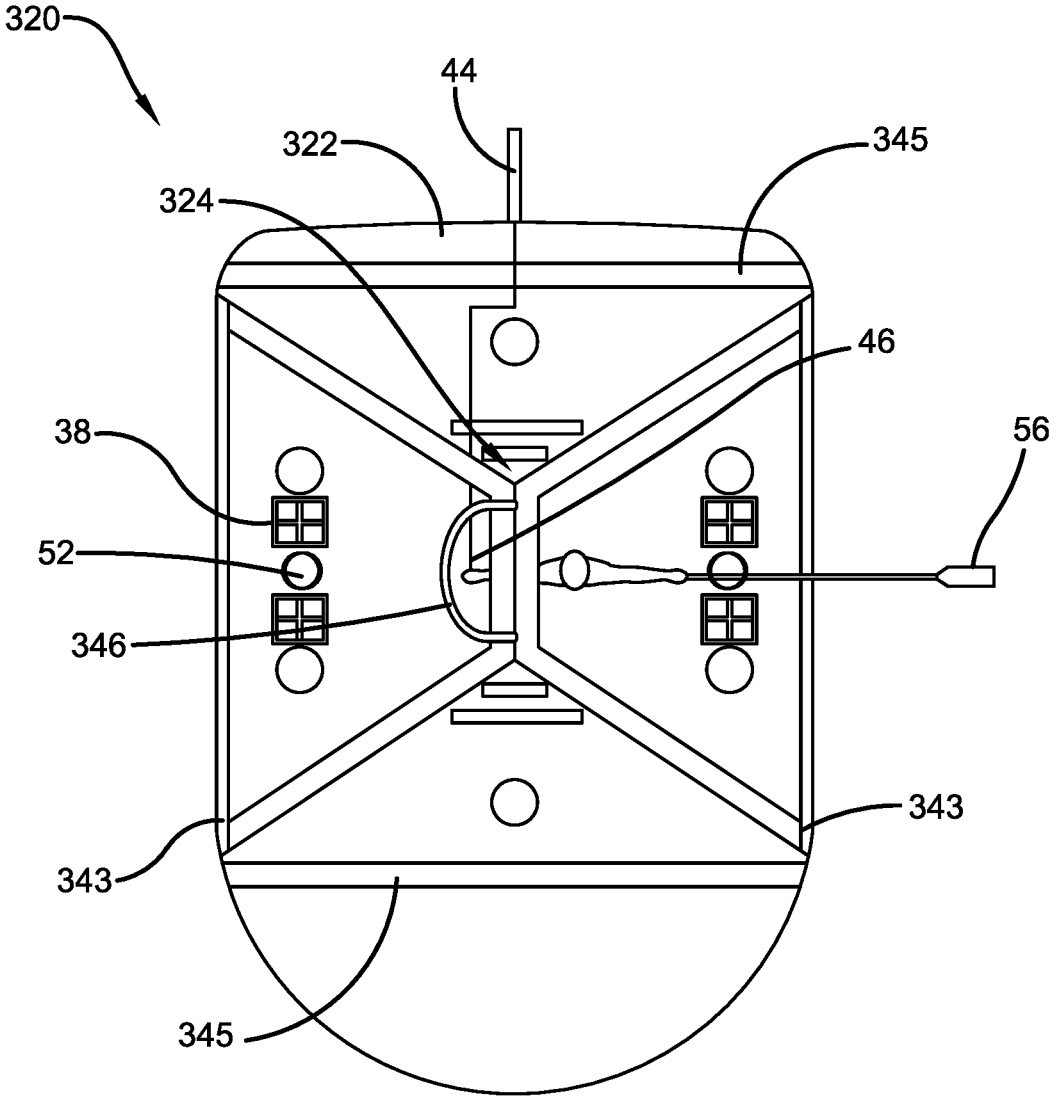
FIG. 15 is a top view of the house of FIG. 12 with additional components being shown and showing strap hinges connecting the roof sidings to the base.
Figure 15A:
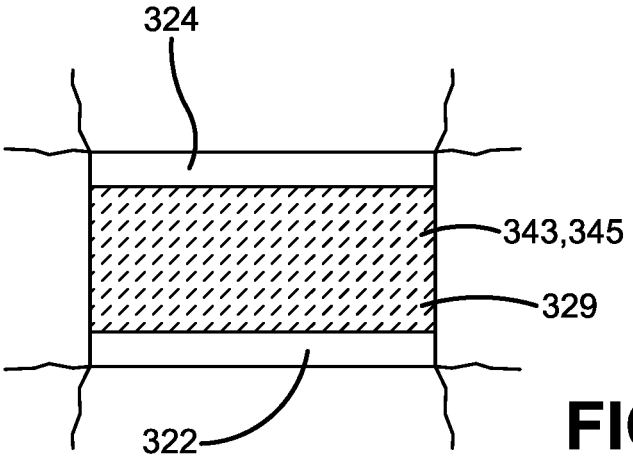
FIG. 15A is a partial side view of a portion of the house of FIG. 15 showing the strap hinge connecting the roof and base.

The bottom ends 326, 330B of each of the roof sidings are pivotally attached to the base 322 by piano hinges 342, 344 (FIG. 12) or strap hinges 343, 345 (FIG. 15) to enable the roof sidings to pivot away from the apex of the roof in an unfolded positioned as shown in FIG. 13 and then pivot back towards the apex of the roof to be assembled in an operative position as shown in FIGS. 12 and 15. Specifically, the hinges 342 for the right and left roof sidings 324R, 324L, and the hinges 344 for the front and rear roof sidings 324F, 324B may, for example, be piano hinges as shown in FIG. 12. Alternatively, the hinges 343 for the right and left roof sidings 324R, 324L, and the hinges 345 for the front and rear roof sidings 324F, 324B may be strap hinges as shown in FIGS. 15 and 15A. For the straps hinges 343, 345, waterproof straps are glued between the roof sidings of the roof 324 and the base 322 and are flexible but durable so that they can function as hinges to enable the roof sidings to pivot relative to the base. The waterproof straps would be glued to the roof sidings and the base by waterproof glue. The strap hinges 343, 345 may covered by a flexible waterproof rubber coating 329 (FIG. 15A) to protect the strap hinge from chipping, cracking and breaking. Alternatively, other suitable types of hinges may be used as well.

Figure 23:
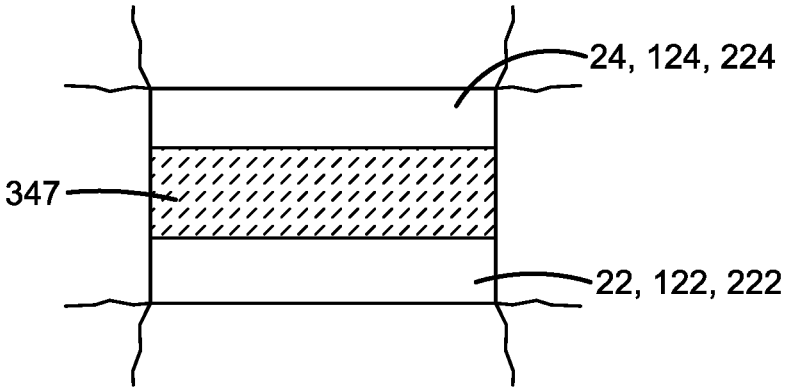
FIG. 23 is a partial side sectional view of a portion of a floatable house showing a gasket sandwich between the roof and base of the floatable house.

A carrying handle 346 may be attached to the roof at the apex in this embodiment as well as the other above-mentioned embodiments. Rubber gaskets 339R, 339L (FIG. 13) are provided around respective right and left roof sidings 324R, 324L to provide a seal (via the gasket portions) between the adjacent ends of each pair of adjacent sidings and between the base 322 and the bottom ends of the right and left roof sidings 324R, 324L to prevent water from entering into the house. Gaskets 341F, 341B (FIG. 13) are also provided between the bottom ends of the front and rear roof sidings 324F, 324B and base 322 to seal those areas to prevent water from enter the house through those areas. As illustrated in FIG. 23, a gasket 347 can also be sandwiched between the roof 24, 124, or 224 and the base 22, 122, or 222 of the other embodiments to seal and prevent water from entering the house between the roof and base.

The base 322 of the house 320 may include the bolts 28 located adjacent each of the bottom ends 330B of the right and left roof sidings 324R, 324L that extend downwardly. The bolts 28 act as stops to limit the pivoting movement of right and left roof sidings 324R, 324L such that the right and left roof sidings 324R, 324L are level with the base 320 when the right and left roof sidings 324R, 324L are folded underneath the base 320 in a compact stowed position as shown in FIG. 14. Also, in the stowed position, a first stretch cord 350 may extend over the width of the base 322 and have hooks 352 on its opposite ends that are hooked into openings of their respective right and left roof sidings 324R, 324L to keep the right and left roof sidings 324R, 324L folded against the underside of the base 322. A second stretch cord 354 with hooks 356 on its opposite ends may hook into openings of the front and rear roof sidings 324F, 324B to hook them together in the stowed position and keep them folded against the top side of the base 322.

The roof 324 may include a transparent window 38 on the left and right roof sidings as seen in FIG. 15 or alternatively the roof 324 may be entirely transparent. Foam balls 40 may also be mounted to the roof 324 to provide additional buoyancy to the house 320 to support the house 320 and prevent the house 320 from capsizing in the water from strong waves. For example, two foam balls 40 may be mounted to each of the right and left roof sidings 324R, 324L, and one foam ball 40 may be mounted to the front and rear roof siding 324F, 324B. As seen in FIG. 5, one or more of the balls 40 may include a threaded fastener 81 such as a screw that engages a threaded hole 82 in the roof 324. Alternatively, one or more of the balls 40 may include tabs 84 that engage grooves 86 formed in the roof 324 as illustrated in FIG. 6. Specifically, the tabs 84 are inserted into the grooves 86 and then the ball 40 is turn or twisted such that the tabs 84 engage the underside of the roof 324. The house 320 also has the round flat weight 42 screwed into or otherwise installed in the bottom of the base 322 to constitute a center of gravity to help maintain the house 320 in an upright position when it is subjected to the movement by waves and wind.

Similar to the first embodiment, a moveable rudder 44 may be pivotally mounted to the base 322 to steer the house 320 as it floats in the water. The rudder 44 includes a fin 46 and an elongated handle 48 (FIG. 1). The handle 48 is elongated to enable a user to turn or move the rudder right and left at 85 degree angles from the longitudinal axis of the base 322 for each of the right and left sides of the house 20 to steer the house 20. Alternatively or additionally, a trolling or gas operated motor 50 (FIG. 4) may be installed at the rear of the house 320. Alternatively or additionally, an access opening 52 (FIG. 1) may be provided in the roof 324 to enable a handle 54 of an oar 56 to pass through to allow a user to row the floatable house 320 with the oar. A seat or chair 58 may be provided in the house 320 to allow a user to sit while operating the rudder 44, trolling or gas operated motor 50, or oar 56. The house 320 may include a sleeve 60 mounted to the base 322 that slidingly receives the fin 46 of the rudder 44 to allow the fin 46 to be slid to selected positions.

A locking mechanism 62 may cooperated with the sleeve 60 to lock the fin 46 in a selected position along the sleeve 60. The locking mechanism 62 may be a pin, spring lock, screw, wing screw or other suitable mechanism. FIG. 3A illustrates a first example of the locking mechanism 62. In this example, the locking mechanism 62 comprises a cotter pin assembly 64 in which a pin 66 is slidably inserted into aligned holes 67 at the distal end of the sleeve 60 and then locked therein by a u-shaped spring 68 inserted into a hole 70 in a shank 72 of the pin as illustrated in FIG. 3A. The opposite ends of the sleeve are sandwiched between a head 74 of the pin and the spring 68 In a second example, the locking mechanism 62 comprises a wing screw 76 that screws into and threadily engages aligned threaded holes 78 at the distal end of the sleeve 60 as shown in FIG. 3B. In a third example, the locking mechanism may be a spring lock 80 in the form of a push-push mechanism that is part of the sleeve as illustrated in FIG. 3C. Specifically, the spring goes through a hole at the distal end of the sleeve. Pushing the top portion of the spring lock urges the spring lock 80 up away from the sleeve to allow the rudder 44 to slide out. The sleeve 60 may have a release button that when pressed, unlocks the locking mechanism 62 and allows removal of the fin 46. As depicted in FIG. 3D, latches 69 may be pivotally mounted on sliding groove 63 at the distal end of the sleeve 60 to prevent the fin from sliding out of the sleeve 60. The latches 69 are initially locked in the position shown in FIG. 3D to prevent the fin 46 from sliding out. The latches 69 can be unlocked and pivotally moved out of the groove by pressing a release button or using other suitable ways to unlock the latches 69, so that the fin 46 may be allowed to slide out of the sleeve 60.

In one or more of the above-mentioned embodiments, a sponge layer 360 (FIG. 14) that absorbs impacts may also be installed on the underside of the roofs to protect the pets from hitting the roof. In one or more of the above-mentioned embodiments, there may also be a spongy rack 362 (FIG. 14) removably mounted on the top side or floor of the house for receiving a pet's waste. Also, in one or more of the above-mentioned embodiments, there may be a rope 364 (FIG. 12) secured to the front or bow of the house to enable a user to the pull the house along the water, and a draining hose 366 (FIG. 12) to drain water that gets inside the house. The draining hose 366 may include a check valve 368 that opens one way to drain the water but prevent back flow of the water into the house. There may be two drain hoses 366 which include the check valves 368 in two different corners of the base in order to drain the water if in case a few drops of water gets in by the big waves. The check valves 368 are engineered to drain the water and they would be closed to the water from outside. In embodiments of houses that are constructed for pets, the fin can be installed in the bottom of the base by twisting it on the base.

In each of the above-mentioned embodiments, the entire exterior surface of the base may be covered by a flexible waterproof rubber coating 370 (as illustrated in FIG. 21 and FIGS. 1, 2, 9-11, 13, and 14) to protect it from chipping or cracking. In embodiments where the size of the house is for pets or the house is otherwise only used for pets, the wing bolts or other fasteners 28 may be accessible from the outside of the house to tighten and loosened the wing bolt from the outside. In embodiments where the size of the house is for humans or the house is otherwise used for humans, the wing bolts or other fasteners 28 may be accessible from the inside of the house to tighten and loosened the wing bolt from the inside.

Figure 16:
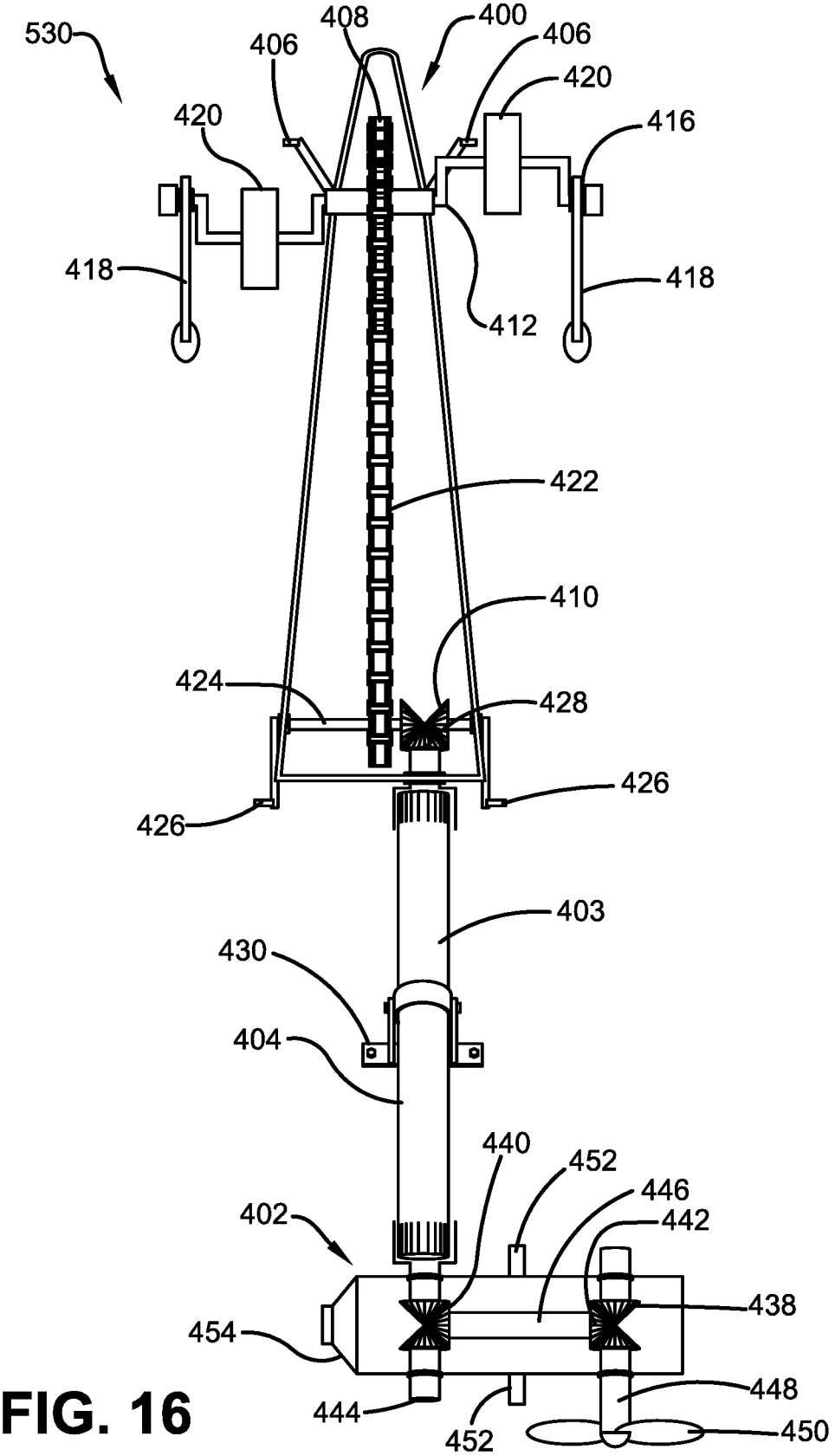
FIG. 16 is a top view of a manually powered system to move the house with portions removed for illustration according to one embodiment of the present invention.
Figure 22:
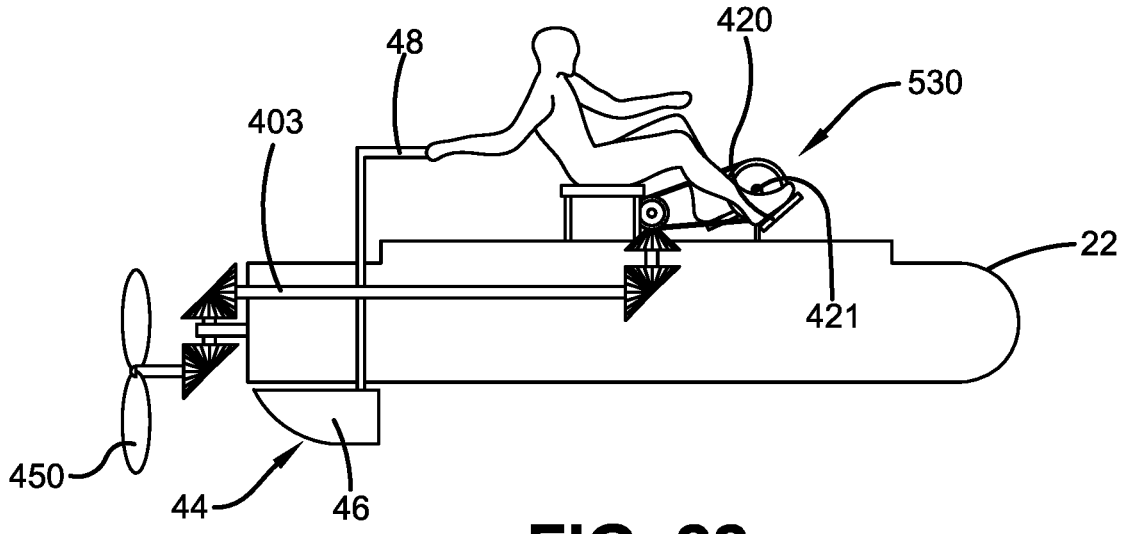
FIG. 22 is schematic left side view of a portion of a floatable house according to the embodiment of FIG. 1 showing the manually powered system of FIG. 16 and rudder mounted on the base of the house with portions removed for illustration.

Instead of a trolling or gas operated motor 50, a system may be provided in one or more of the embodiments to manually power the house forward and rearward along the water. FIGS. 16 and 22 show an exemplary version of a manually powered system 530. The manually powered system 530 includes a front unit 400 and a rear unit 402 and a driveshaft 403 operatively connecting the front unit 400 to the rear unit 402 in a manner that allows them to be easily assembled and disassembled from each other. The front unit 400 includes a frame 404 that is installed horizontally on the base 22, 122, 222, or 322 of the house. The front part of the frame is locked to the base by spring latches 406. Other fasteners such as bolts, clamps, or other latches can alternatively be used to lock the front part of the frame to the base 22, 122, 222, or 322 of the house. The frame 404 houses a front chain gear 408 and, at the rear part of the frame, a female beveled chain gear 410. The manually powered system 530 includes a chain gear shaft 412 that laterally extends through the front chain gear 408. The chain gear shaft 412 also extends through bearings 416 and the frame 404 for supporting the chain gear shaft 412. Two hand operated arms 418 are removably assembled to the chain gear shaft 412 for rotating the chain gear shaft 412 to move the house along the water. The arms 418 extend transversely with respect to the chain gear shaft 412 for enabling a user to rotate the arms 418 and chain gear shaft 412 about the longitudinal axis of the chain gear shaft 412 to move the house along the water. Additionally, two foot operated pedals 420 are operatively connected via crank arms 421 (FIG. 22) to the chain gear shaft 412 and front chain gear 408 to also rotate the chain gear shaft 412 using a pedal cycle motion to move the house along the water. The female beveled chain gear 410 includes a toothed region that defines a notch.

A chain 422 engages the front chain gear 408 and the female beveled chain gear 410 via a first gear shaft 424 that extends through the female beveled chain gear 410. The first gear shaft 424 also extends through the frame 404 and 416 bearings for supporting the first gear shaft 424. The rear part of the frame 404 is locked to the base by latches 426. Other fasteners such as bolts and clamps can alternatively be used to lock the rear part of the frame 404 to the base 22, 122, 222, or 322 of the house. A first male beveled gear 428 is provided and has a toothed region that extends into the notch and meshingly engages the toothed region of the female beveled chain gear 410.

The first male beveled gear 428 is fixed to a front axial end of the driveshaft 403. The driveshaft 403 extends rearwardly from the first male beveled gear 428 and has an axis of rotation that is perpendicular to the axis of rotation of the first gear shaft 424. A driveshaft support 430 is mounted to the base and engages the driveshaft 403 to support the driveshaft 403. A second gear shaft 432 is fixed to the rear axial end of the driveshaft 403 and extends rearwardly from the driveshaft 403.

The rear unit 402 includes a gear box 434. The gear box houses 434 first and second female beveled gears 436, 438, second and third male beveled gears 440, 442, bearings 416, second and third gear shaft 444, 446, and a propeller shaft 448. Each of the female beveled gears 436, 438 includes a toothed regions that defines a notch. The second gear shaft 444 extends through the first female beveled gear 436, and also through the gear box 434 and bearings 416 for supporting the second gear shaft 444. The second male beveled gear 440 has a toothed region that extends into the notch of the first female beveled gear 436 and meshingly engages the toothed region of the first female beveled gear 436. The second male bevel gear 440 is fixed on an axial end of the third gear shaft 446. The third male beveled gear 440 is fixed to the other axial end of the third gear shaft 444. The second male beveled gear 440 has a toothed region that extends into the notch of the second female beveled gear 438 and meshingly engages the toothed region of the second female beveled gear 438. The propeller shaft 448 extends through the second female beveled gear 438, and also through the gear box 434 and bearings 416 for supporting the propeller shaft 448. A propeller 450 is fixed to the rear axial end of the propeller shaft 448.

The propeller shaft 448 is parallel to the second gear shaft 444. The third gear shaft 446 is perpendicular to the propeller shaft 448 and the second gear shaft 444. The rear unit 402 is slidingly installed in the back of the base in a vertical orientation by fasteners 452 such as a latches, bolts or clamp locks. A handle 454 is attached to the gear box 434 for carrying the gear box 434. Operation of one of the hand arms 418 and/or one of the pedals 420 by a user causes rotation of the front chain gear 408, the chain 422, the female beveled chain gear 410 via the chain 422, the first male beveled gear 428, the drive shaft 403, the second gear shaft 444 and first female beveled gear 436, the second male beveled gear, the third gear shaft 446, the third male beveled gear 442, the second female beveled gear 438, the propeller shaft 448, and the propeller 450 to move the house along the water. The user can steer the house using the rudder 44. The hand arms 418 and pedals 420 provide a user the option to operate one of them to move the house forward and backward if they cannot operate the other or allows the user to operate both of them at the same time to move the house.

Figure 17:
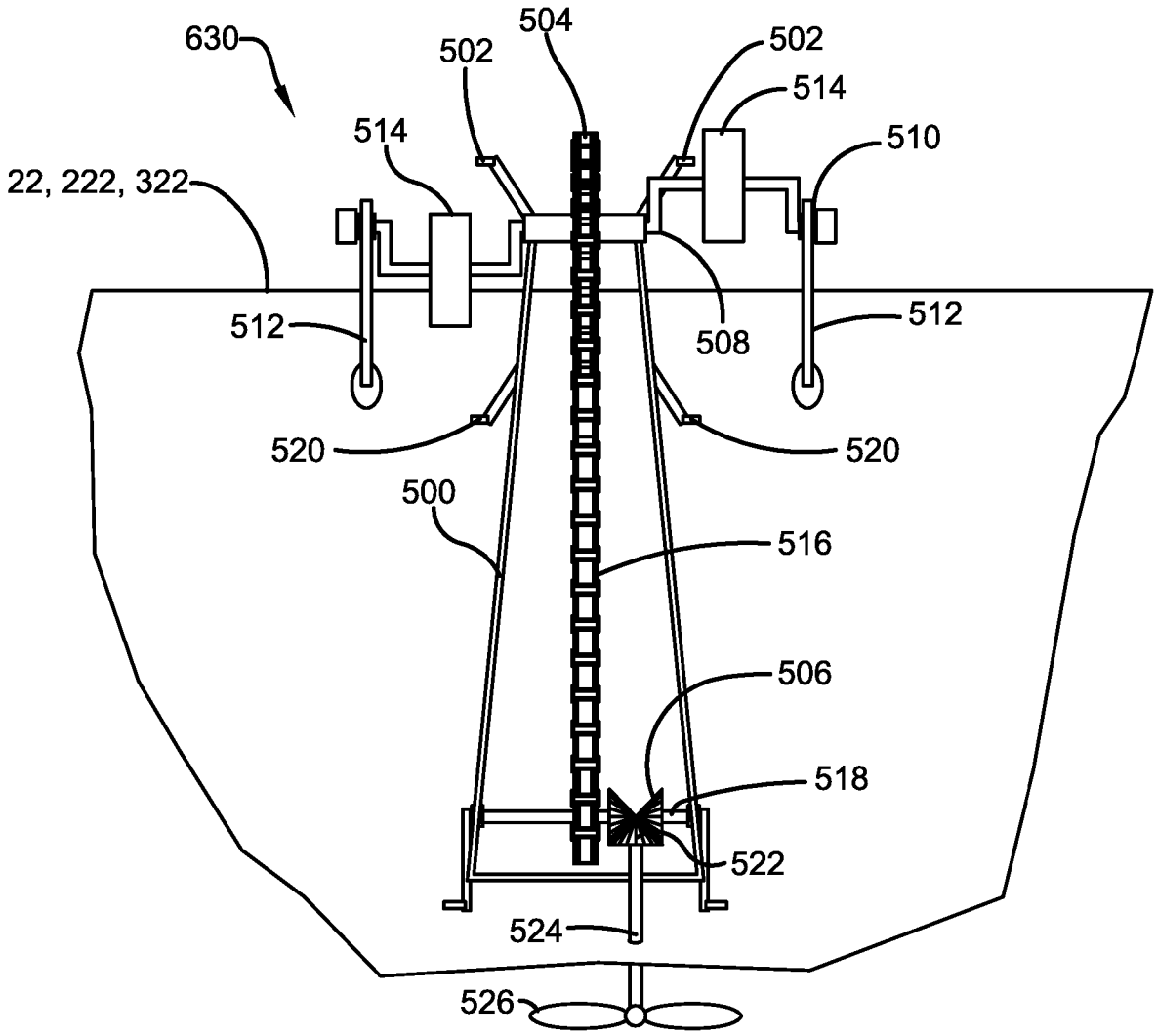
FIG. 17 is a top view of a manually powered system to move the house with portions removed for illustration according to another embodiment of the present invention.

FIG. 17 shows another embodiment of the exemplary version of a manually powered system 630. In this embodiment, the manually powered system 630 is installed vertically through the middle of the base 22, 122, 222, or 322 of the house to the bottom of the base. The manually powered system 630 includes a frame 500 that is locked at its upper portion to the base by spring latches 502. Other fasteners such as bolts, clamps, or other latches can alternatively be used to lock the upper portion of the frame 500 to the base 22, 222, or 322 of the house. The frame 500 houses an upper chain gear 504 and, at the lower portion of the frame 500, a female beveled chain gear 506. The manually powered system 630 includes a chain gear shaft 508 that laterally extends through the upper chain gear 504. The chain gear shaft 508 also extends through bearings 510 and the frame 500 for supporting the chain gear shaft 508. Two hand operated arms 512 are removably assembled to the chain gear shaft 508 for rotating the chain gear shaft 508 to move the house along the water. The arms 512 extend transversely with respect to the chain gear shaft 508 for enabling a user to rotate the arms 512 and chain gear shaft 508 about the longitudinal axis of the chain gear shaft 508 to move the house along the water. Additionally, two foot operated pedals 514 are operatively connected to the chain gear shaft 508 via crank arms 421 (FIG. 22) and upper chain gear 504 to also rotate the chain gear shaft 508 using a pedal cycle motion to move the house along the water. The female beveled chain gear 506 includes a toothed region that defines a notch.

A chain 516 engages the upper chain gear 504 and the female beveled chain gear 506 via a gear shaft 518 that extends through the female beveled chain gear 506. The gear shaft 518 also extends through the frame 500 and bearings 510 for supporting the gear shaft 518. The lower portion of the frame 500 is locked to the base by latches 520. Other fasteners such as bolts and clamps can alternatively be used to lock the lower portion of the frame 500 to the base 22, 122, 222, or 322 of the house. A male beveled gear 522 is provided and has a toothed region that extends into the notch and meshingly engages the toothed region of the female beveled chain gear 506.

The male beveled gear 522 is fixed to an axial end of a propeller shaft 524. The propeller shaft 524 extends rearwardly relative to the base and has an axis of rotation that is parallel to the axis of rotation of the gear shaft 518. A propeller 526 is fixed to the other axial end of the propeller shaft 524. Operation of one of the hand arms 512 and/or one of the pedals 514 by a user causes rotation of the upper chain gear 504 which rotates the chain 516, the female beveled chain gear 506, the male beveled gear 522, the propeller shaft 524, and the propeller 526 to move the house along the water. The user can steer the house using the rudder 44 (FIG. 22). The hand arms 512 and pedals 514 provide a user the option to operate one of them to move the house forward and backward if they cannot operate the other or allows the user to operate both of them at the same time to move the house. An electric motor powered by a battery can be added to provide additional power to the system 530 or 630 to assist the user to manually operate one of the hand arms 418, 512 and/or one of the pedals 420, 514 to rotate the propeller 450 or 526.

The roof and sidings and door of the base of each of the embodiments being comprised of flexible plastic is bendable but not breakable when subjected to strong winds and current. The round foamed balls installed on the roof support the roof and prevent it from collapsing or capsizing. In the embodiments of the present invention, the top part of the base is a few inches higher than the outer edges all around the base which is lower than the top sections and it is on the surface of water. The two lips which are over each vent from outside and below it from inside restrict the water. Also, in several embodiments, the floating house may have lids from inside the house which are attached to the roof by the straps to cover the vents by closing to prevent the water completely in some conditions.

As described in the above embodiments, a floatable house is provided. The house or cage is comprised of foam and plastic. In several embodiments, the house can be folded or assembled by a user. In severable embodiments, the house is a "breathable house in which the house has openings that allow for the entry of fresh air and the exit of stale air. The house can be made in different sizes to accommodate different sizes of pets. The house is lightweight and portable so that it can be easily handled and carried by one person.

The house of the present invention has utility in natural disasters that result in flooding of areas that are homes to pets and humans. Such pets and even if necessary, humans, can use the house for a floating "shelter" during such flooding. The design of the house and its composition of light-weight but substantial materials enables the house to be effectively unsinkable and unbreakable in strong winds, waves and currents as may be encountered in storms. The house is stable and is balanced so as to maintain an upright position on water at all times without collapsing. After use, in several embodiments, the house of the invention can be unfolded and disassembled so that it occupies minimal space in a storeroom, home, garage or automobile.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above-described embodiments, method, and examples, but by all embodiments and methods within the scope and spirit of the invention.

What is claimed is:

1. A floatable house comprising:

a buoyant base, wherein the buoyant base is configured to be made of a closed-cell foam that has a lower density of water to enable the house to float on water;

a roof, wherein the roof is attached to the base; and a manually powered system, wherein the manually powered system comprises:

a propeller;

a hand operated arm;

a pedal, wherein the hand operated arm and the pedal are in operative connection with the propeller, wherein the hand operated arm and the pedal are each configured to be operated by a user to cause rotation of the propeller to move the house along the water;

a driveshaft, wherein the driveshaft operatively connects the hand operated arm and the pedal to the propeller, wherein the hand operated arm and the pedal are each configured to be operated by a user to cause rotation of the driveshaft, wherein rotation of the driveshaft causes rotation of the propeller;

a first chain gear;

a first chain gear shaft, wherein the first chain gear shaft extends through the first chain gear and rotates with the first chain gear, wherein the pedal and the hand operated arm are connected to the first chain gear shaft and each operate to cause the first chain gear shaft to rotate;

a chain; and a second chain gear, wherein the chain engages the first chain gear and the second chain gear, wherein the driveshaft is operatively connected to the second chain gear, wherein operation of the one of the pedal and the hand operated arm or both the pedal and the hand operated arm causes rotation of the first chain gear shaft, the first chain gear, the chain, the second chain gear, the driveshaft and the propeller to move the house along the water.

2. The floatable house of claim 1 further comprising:

a rudder, wherein the rudder includes an elongated handle, wherein the handle is operative to enable a user to move the rudder right and left to steer the house.

3. The floatable house of claim 1, wherein both the pedal and the hand operated arm are connected to the first chain gear shaft and operate to cause the first chain gear shaft to rotate, wherein the first chain gear shaft extends through the pedal and hand operated arm.

4. The floatable house of claim 3, wherein second chain gear comprises a first beveled gear.

5. The floatable house of claim 4 further comprising a second beveled gear, wherein second beveled gear is fixed to the drive shaft, w herein the second beveled gear meshingly engages the first beveled gear.

6. The floatable house of claim 5, further comprising second and third gear shafts, wherein the second gear shaft is fixed to a rear axial end of the driveshaft and extends rearwardly from the driveshaft, wherein the second gear shaft extends through a third beveled gear, a fourth beveled gear, wherein the fourth beveled gear is fixed to an axial end of the third gear shaft, wherein the fourth beveled gear meshingly engages the third beveled gear, wherein the third gear shaft is in operative connection with the propeller, wherein operation of the one of the pedal and the hand operated arm or both the pedal and the hand operated arm causes rotation of the first chain gear shaft, the first chain gear, the chain, the second chain gear, the driveshaft, the second and third gear shafts and the propeller to move the house along the water.

7. A floatable house comprising:

a buoyant base, wherein the buoyant base is configured to be made of one of plastic and a closed-cell foam that has a lower density of water to enable the house to float on water;

a roof, wherein the roof is removably attached to the base;

wherein the base includes a floor, wherein the floor is configured to receive a user or animal, wherein the floor is located above the water line;

a gasket, wherein the gasket is sandwiched between the roof and the base; and one or more vented openings in the roof and outer and inner lips, wherein the outer lip is located outside the house and is attached to or near the upper end of the vent opening, wherein the upper lip extends downwardly from the upper end of the vent opening and partially over the vent opening, wherein the inner lip is located inside the house and is attached to or near a lower end of the vent opening, wherein the inner lip extends partially underneath the vent opening from the lower end of the vent opening, wherein the inner and outer lips are operative to restrict water from entering through the vented openings.

8. The floatable house of claim 7 further comprising:

a drain hose;

a check valve, wherein the drain hose is operative to drain water from inside the house, wherein the check valve is fluidly connected in the drain hose to prevent water from backflowing through the drain hose and into the house;

a weight, wherein the weight is installed in the center of the base to support the center of gravity of the floatable house to provide stability to the floatable house as the floatable house floats on the water; and an impact absorbing layer attached to an underside of the roof, wherein the roof is at least partially transparent.

9. The floatable house of claim 7 further comprising a door, wherein the door is pivotably connected to the roof and is positioned over an opening of the roof.

10. The floatable house of claim 9, wherein the door is pivotably connected to the roof by waterproof hinge straps.

11. The floatable house of claim 10, wherein the waterproof hinge straps comprises a waterproof coating, wherein the coating is configured to protect the hinges from chipping, cracking and breaking.

12. The floatable house of claim 7 further comprising a rear sliding door, wherein the rear sliding door is positioned over an opening of the roof.

13. The floatable house of claim 7, wherein the base has an exterior surface that is substantially covered by a flexible waterproof coating, wherein the coating is configured to protect the base from chipping, cracking and breaking.

14. The floatable house of claim 7, wherein the roof is oval shaped.

15. The floatable house of claim 7 further comprising vented openings in the roof, wherein the vented openings are uncovered.

16. A floatable house comprising:

a buoyant base, wherein the buoyant base is configured to be made of a closed-cell foam that has a lower density of water to enable the house to float on water;

a roof, wherein the roof is attached to the base; and one or more hemispherical buoyant balls attached to roof to provide additional buoyancy to the house to help prevent the house from capsizing in the water, wherein the balls are attached directly to the roof and located below the top of the roof.

* * * * *